US008117842B2

(12) United States Patent
McBride et al.

(10) Patent No.: US 8,117,842 B2
(45) Date of Patent: Feb. 21, 2012

(54) SYSTEMS AND METHODS FOR COMPRESSED-GAS ENERGY STORAGE USING COUPLED CYLINDER ASSEMBLIES

(75) Inventors: Troy O. McBride, West Lebanon, NH (US); Benjamin R. Bollinger, West Lebanon, NH (US); Michael Schaefer, West Lebanon, NH (US); Dax Kepshire, West Lebanon, NH (US)

(73) Assignee: SustainX, Inc., Seabrook, NH (US)

( * ) Notice: Subject to any disclaimer, the term of this patent is extended or adjusted under 35 U.S.C. 154(b) by 0 days.

(21) Appl. No.: 13/026,677

(22) Filed: Feb. 14, 2011

(65) Prior Publication Data

US 2011/0131966 A1 Jun. 9, 2011

Related U.S. Application Data

(63) Continuation of application No. 12/938,853, filed on Nov. 3, 2010.

(60) Provisional application No. 61/257,583, filed on Nov. 3, 2009, provisional application No. 61/287,938, filed on Dec. 18, 2009, provisional application No. 61/310,070, filed on Mar. 3, 2010, provisional application No. 61/375,398, filed on Aug. 20, 2010.

(51) Int. Cl.
*F16D 31/02* (2006.01)
*F15B 21/04* (2006.01)

(52) U.S. Cl. ..... 60/613; 60/645; 91/4 R

(58) Field of Classification Search ..... 60/645, 60/413–418; 91/4 R, 4 A
See application file for complete search history.

(56) References Cited

U.S. PATENT DOCUMENTS

| | | | |
|---|---|---|---|
| 114,297 | A | 5/1871 | Ivens et al. |
| 224,081 | A | 2/1880 | Eckart |
| 233,432 | A | 10/1880 | Pitchford |
| 1,635,524 | A | 7/1927 | Aikman |
| 1,681,280 | A | 8/1928 | Bruckner |
| 2,025,142 | A | 12/1935 | Zahm et al. |
| 2,042,991 | A | 6/1936 | Harris, Jr. |
| 2,141,703 | A | 12/1938 | Bays |
| 2,280,100 | A | 4/1942 | SinQleton |
| 2,280,845 | A | 4/1942 | Parker |
| 2,404,660 | A | 7/1946 | Rouleau |
| 2,420,098 | A | 5/1947 | Rouleau |
| 2,539,862 | A | 1/1951 | Rushinq |
| 2,628,564 | A | 2/1953 | Jacobs |
| 2,712,728 | A | 7/1955 | Lewis et al. |
| 2,813,398 | A | 11/1957 | Wilcox |

(Continued)

FOREIGN PATENT DOCUMENTS

BE 898225 3/1984

(Continued)

OTHER PUBLICATIONS

International Search Report and Written Opinion mailed May 25, 2011 for International Application No. PCT/US2010/027138, 12 pages.

(Continued)

*Primary Examiner* — Hoang Nguyen
(74) *Attorney, Agent, or Firm* — Bingham McCutchen LLP

(57) ABSTRACT

In various embodiments, a pneumatic cylinder assembly is coupled to a mechanism that converts motion of a piston into electricity, and vice versa, during expansion or compression of a gas in the pneumatic cylinder assembly.

20 Claims, 14 Drawing Sheets

U.S. PATENT DOCUMENTS

| | | | | |
|---|---|---|---|---|
| 2,829,501 | A | | 4/1958 | Walls |
| 2,880,759 | A | | 4/1959 | Wisman |
| 2,966,776 | A | * | 1/1961 | Taga ..... 60/616 |
| 3,041,842 | A | | 7/1962 | Heinecke |
| 3,236,512 | A | | 2/1966 | Caslav et al. |
| 3,269,121 | A | | 8/1966 | Ludwig |
| 3,538,340 | A | | 11/1970 | LanQ |
| 3,608,311 | A | | 9/1971 | Roesel, Jr. |
| 3,648,458 | A | | 3/1972 | McAlister |
| 3,650,636 | A | | 3/1972 | Eskeli |
| 3,672,160 | A | | 6/1972 | Kim |
| 3,677,008 | A | | 7/1972 | Koutz |
| 3,704,079 | A | | 11/1972 | Berlyn |
| 3,757,517 | A | | 9/1973 | RiQollot |
| 3,793,848 | A | | 2/1974 | Eskeli |
| 3,801,793 | A | | 4/1974 | Goebel |
| 3,803,847 | A | | 4/1974 | McAlister |
| 3,839,863 | A | | 10/1974 | Frazier |
| 3,847,182 | A | | 11/1974 | Greer |
| 3,877,180 | A | * | 4/1975 | Brecker ..... 451/24 |
| 3,895,493 | A | | 7/1975 | Riqollot |
| 3,903,696 | A | | 9/1975 | Carman |
| 3,935,469 | A | | 1/1976 | Haydock |
| 3,939,356 | A | | 2/1976 | Loane |
| 3,942,323 | A | | 3/1976 | Maillet |
| 3,945,207 | A | | 3/1976 | Hyatt |
| 3,948,049 | A | | 4/1976 | Ohms et al. |
| 3,952,516 | A | | 4/1976 | Lapp |
| 3,952,723 | A | | 4/1976 | Browning |
| 3,958,899 | A | | 5/1976 | Coleman, Jr. et al. |
| 3,986,354 | A | | 10/1976 | Erb |
| 3,988,592 | A | | 10/1976 | Porter |
| 3,988,897 | A | | 11/1976 | Strub |
| 3,990,246 | A | | 11/1976 | Wilmers |
| 3,991,574 | A | | 11/1976 | Frazier |
| 3,996,741 | A | | 12/1976 | HerberQ |
| 3,998,049 | A | | 12/1976 | McKinley et al. |
| 4,008,006 | A | | 2/1977 | Bea |
| 4,027,993 | A | | 6/1977 | Wolff |
| 4,030,303 | A | | 6/1977 | Kraus et al. |
| 4,031,702 | A | | 6/1977 | Burnett et al. |
| 4,031,704 | A | | 6/1977 | Moore et al. |
| 4,041,708 | A | | 8/1977 | Wolff |
| 4,050,246 | A | | 9/1977 | Bourquardez |
| 4,055,950 | A | | 11/1977 | Grossman |
| 4,058,979 | A | | 11/1977 | Germain |
| 4,089,744 | A | | 5/1978 | Cahn |
| 4,095,118 | A | | 6/1978 | Ratbun |
| 4,100,745 | A | | 7/1978 | Gyarmathy et al. |
| 4,104,955 | A | | 8/1978 | Murphy |
| 4,108,077 | A | | 8/1978 | Laing |
| 4,109,465 | A | | 8/1978 | Plen |
| 4,110,987 | A | | 9/1978 | Cahn et al. |
| 4,112,311 | A | | 9/1978 | Theyse |
| 4,117,342 | A | | 9/1978 | Melley, Jr. |
| 4,117,696 | A | | 10/1978 | Fawcett et al. |
| 4,118,637 | A | | 10/1978 | Tackett |
| 4,124,182 | A | | 11/1978 | Loeb |
| 4,126,000 | A | | 11/1978 | Funk |
| 4,136,432 | A | | 1/1979 | Melley, Jr. |
| 4,142,368 | A | | 3/1979 | Mantegani |
| 4,147,204 | A | | 4/1979 | Pfenninger |
| 4,149,092 | A | | 4/1979 | Cros |
| 4,150,547 | A | | 4/1979 | Hobson |
| 4,154,292 | A | | 5/1979 | Herrick |
| 4,167,372 | A | | 9/1979 | Tackett |
| 4,170,878 | A | | 10/1979 | Jahniq |
| 4,173,431 | A | | 11/1979 | Smith |
| 4,189,925 | A | | 2/1980 | Long |
| 4,197,700 | A | | 4/1980 | Jahniq |
| 4,197,715 | A | | 4/1980 | Fawcett et al. |
| 4,201,514 | A | | 5/1980 | Huetter |
| 4,204,126 | A | | 5/1980 | Diggs |
| 4,206,608 | A | | 6/1980 | Bell |
| 4,209,982 | A | | 7/1980 | Pitts |
| 4,220,006 | A | | 9/1980 | Kindt |
| 4,229,143 | A | | 10/1980 | Pucher |
| 4,229,661 | A | | 10/1980 | Mead et al. |
| 4,232,253 | A | | 11/1980 | Mortelmans |
| 4,237,692 | A | | 12/1980 | Ahrens et al. |
| 4,242,878 | A | | 1/1981 | Brinkerhoff |
| 4,246,978 | A | | 1/1981 | Schulz et al. |
| 4,262,735 | A | | 4/1981 | Courrege |
| 4,273,514 | A | | 6/1981 | Shore et al. |
| 4,274,010 | A | | 6/1981 | Lawson-tancred |
| 4,275,310 | A | | 6/1981 | Summers et al. |
| 4,281,256 | A | | 7/1981 | Ahrens |
| 4,293,323 | A | | 10/1981 | Cohen |
| 4,299,198 | A | | 11/1981 | Woodhull |
| 4,302,684 | A | | 11/1981 | Gogins |
| 4,304,103 | A | | 12/1981 | Hamrick |
| 4,311,011 | A | | 1/1982 | Lewis |
| 4,316,096 | A | | 2/1982 | Syverson |
| 4,317,439 | A | | 3/1982 | Emmerling |
| 4,335,867 | A | | 6/1982 | Bihlmaier |
| 4,340,822 | A | | 7/1982 | Gregg |
| 4,341,072 | A | | 7/1982 | Clyne |
| 4,348,863 | A | | 9/1982 | Taylor et al. |
| 4,353,214 | A | | 10/1982 | Gardner |
| 4,354,420 | A | | 10/1982 | Bianchetta |
| 4,355,956 | A | | 10/1982 | Ringrose et al. |
| 4,358,250 | A | | 11/1982 | Payne |
| 4,367,786 | A | | 1/1983 | Hafner et al. |
| 4,368,692 | A | | 1/1983 | Kita |
| 4,368,775 | A | | 1/1983 | Ward |
| 4,370,559 | A | | 1/1983 | Langley, Jr. |
| 4,372,114 | A | | 2/1983 | Burnham |
| 4,375,387 | A | | 3/1983 | deFilippi et al. |
| 4,380,419 | A | | 4/1983 | Morton |
| 4,393,752 | A | | 7/1983 | Meier |
| 4,411,136 | A | | 10/1983 | Funk |
| 4,421,661 | A | | 12/1983 | Claar et al. |
| 4,428,711 | A | | 1/1984 | Archer |
| 4,435,131 | A | | 3/1984 | Ruben |
| 4,444,011 | A | | 4/1984 | Kolin |
| 4,446,698 | A | | 5/1984 | Benson |
| 4,447,738 | A | | 5/1984 | Allison |
| 4,449,372 | A | | 5/1984 | Rilett |
| 4,452,046 | A | | 6/1984 | Valentin |
| 4,454,429 | A | | 6/1984 | Buonome |
| 4,454,720 | A | | 6/1984 | Leibowitz |
| 4,455,834 | A | | 6/1984 | Earle |
| 4,462,213 | A | | 7/1984 | Lewis |
| 4,474,002 | A | | 10/1984 | Perry |
| 4,476,851 | A | | 10/1984 | Brugger et al. |
| 4,478,553 | A | | 10/1984 | Leibowitz et al. |
| 4,489,554 | A | | 12/1984 | Otters |
| 4,491,739 | A | | 1/1985 | Watson |
| 4,492,539 | A | | 1/1985 | Specht |
| 4,493,189 | A | | 1/1985 | Slater |
| 4,496,847 | A | | 1/1985 | Parkings |
| 4,498,848 | A | | 2/1985 | Petrovsky |
| 4,502,284 | A | | 3/1985 | Chrisoqhilos |
| 4,503,673 | A | | 3/1985 | Schachle |
| 4,515,516 | A | | 5/1985 | Perrine et al. |
| 4,520,840 | A | | 6/1985 | Michel |
| 4,525,631 | A | | 6/1985 | Allison |
| 4,530,208 | A | | 7/1985 | Sato |
| 4,547,209 | A | | 10/1985 | Netzer |
| 4,585,039 | A | | 4/1986 | Hamilton |
| 4,589,475 | A | | 5/1986 | Jones |
| 4,593,202 | A | | 6/1986 | Dickinson |
| 4,619,225 | A | | 10/1986 | Lowther |
| 4,624,623 | A | | 11/1986 | Wagner |
| 4,648,801 | A | | 3/1987 | Wilson |
| 4,651,525 | A | | 3/1987 | Cestero |
| 4,653,986 | A | | 3/1987 | Ashton |
| 4,671,742 | A | | 6/1987 | Gyimesi |
| 4,676,068 | A | | 6/1987 | Funk |
| 4,679,396 | A | | 7/1987 | Heggie |
| 4,691,524 | A | | 9/1987 | Holscher |
| 4,693,080 | A | | 9/1987 | Van Hooff |
| 4,706,456 | A | | 11/1987 | Backe |
| 4,707,988 | A | | 11/1987 | Palmers |
| 4,710,100 | A | | 12/1987 | Laing et al. |
| 4,735,552 | A | | 4/1988 | Watson |
| 4,739,620 | A | | 4/1988 | Pierce |

4,760,697 A 8/1988 Heggie
4,761,118 A 8/1988 Zanarini et al.
4,765,142 A 8/1988 Nakhamkin
4,765,143 A 8/1988 Crawford et al.
4,767,938 A 8/1988 Bervig
4,792,700 A 12/1988 Ammons
4,849,648 A 7/1989 Longardner
4,870,816 A 10/1989 Nakhamkin
4,872,307 A 10/1989 Nakhamkin
4,873,828 A 10/1989 Lainq et al.
4,873,831 A 10/1989 Dehne
4,876,992 A 10/1989 Sobotowski
4,877,530 A 10/1989 Moses
4,885,912 A 12/1989 Nakhamkin
4,886,534 A 12/1989 Castan
4,907,495 A 3/1990 Sugahara
4,936,109 A 6/1990 Lonqardner
4,942,736 A 7/1990 Bronicki
4,947,977 A 8/1990 Raymond
4,955,195 A 9/1990 Jones et al.
4,984,432 A 1/1991 Corey
5,056,601 A 10/1991 Grimmer
5,058,385 A 10/1991 Everett, Jr.
5,062,498 A 11/1991 Tobias
5,107,681 A 4/1992 Wolfbauer, III
5,133,190 A 7/1992 Abdelmalek
5,138,838 A 8/1992 Crosser
5,140,170 A 8/1992 Henderson
5,152,260 A 10/1992 Erickson et al.
5,161,449 A 11/1992 Everett, Jr.
5,169,295 A 12/1992 Stoqner et al.
5,182,086 A 1/1993 Henderson et al.
5,203,168 A 4/1993 Oshina
5,209,063 A 5/1993 Shirai et al.
5,213,470 A 5/1993 Lundquist
5,239,833 A 8/1993 Fineblum
5,259,345 A 11/1993 Richeson
5,271,225 A 12/1993 Adamides
5,279,206 A 1/1994 Krantz
5,296,799 A 3/1994 Davis
5,309,713 A 5/1994 Vassallo
5,321,946 A 6/1994 Abdelmalek
5,327,987 A 7/1994 Abdelmalek
5,339,633 A 8/1994 Fujii et al.
5,341,644 A 8/1994 Nelson
5,344,627 A 9/1994 Fujii et al.
5,364,611 A 11/1994 Iijima et al.
5,365,980 A 11/1994 Deberardinis
5,375,417 A 12/1994 Barth
5,379,589 A 1/1995 Cohn et al.
5,384,489 A 1/1995 Bellac
5,387,089 A 2/1995 Stogner et al.
5,394,693 A 3/1995 Plyter
5,427,194 A 6/1995 Miller
5,436,508 A 7/1995 Sorensen
5,448,889 A 9/1995 Bronicki
5,454,408 A 10/1995 Dibella et al.
5,454,426 A 10/1995 Moseley
5,467,722 A 11/1995 Meratla
5,477,677 A 12/1995 Krnavek
5,491,969 A 2/1996 Cohn et al.
5,491,977 A 2/1996 Cho
5,524,821 A 6/1996 Vie et al.
5,537,822 A 7/1996 Shnaid et al.
5,544,698 A 8/1996 Paulman
5,561,978 A 10/1996 Buschur
5,562,010 A 10/1996 McGuire
5,579,640 A 12/1996 Gray, Jr. et al.
5,584,664 A 12/1996 Elliott et al.
5,592,028 A 1/1997 Pritchard
5,598,736 A 2/1997 Erskine
5,599,172 A 2/1997 Mccabe
5,600,953 A 2/1997 Oshita et al.
5,616,007 A 4/1997 Cohen
5,634,340 A 6/1997 Grennan
5,641,273 A 6/1997 Moseley
5,674,053 A 10/1997 Paul et al.
5,685,155 A 11/1997 Brown
5,768,893 A 6/1998 Hoshino et al.
5,769,610 A 6/1998 Paul et al.
5,771,693 A 6/1998 Coney
5,775,107 A 7/1998 Sparkman
5,778,675 A 7/1998 Nakhamkin
5,794,442 A 8/1998 Lisniansky
5,797,980 A 8/1998 Fillet
5,819,533 A 10/1998 Moonen
5,819,635 A 10/1998 Moonen
5,831,757 A 11/1998 DiFrancesco
5,832,728 A 11/1998 Buck
5,832,906 A 11/1998 Douville et al.
5,839,270 A 11/1998 Jirnov et al.
5,845,479 A 12/1998 Nakhamkin
5,873,250 A 2/1999 Lewis
5,901,809 A 5/1999 Berkun
5,924,283 A 7/1999 Burke, Jr.
5,934,063 A 8/1999 Nakhamkin
5,934,076 A 8/1999 Coney
5,937,652 A 8/1999 Abdelmalek
5,971,027 A 10/1999 Beachley et al.
6,012,279 A 1/2000 Hines
6,023,105 A 2/2000 Youssef
6,026,349 A 2/2000 Heneman
6,029,445 A 2/2000 Lech
6,073,445 A 6/2000 Johnson
6,073,448 A 6/2000 Lozada
6,085,520 A 7/2000 Kohno
6,090,186 A 7/2000 Spencer
6,119,802 A 9/2000 Puett, Jr.
6,132,181 A 10/2000 Mccabe
6,145,311 A 11/2000 Cyphelly
6,148,602 A 11/2000 Demetri
6,153,943 A 11/2000 Mistr, Jr.
6,158,499 A 12/2000 Rhodes
6,170,443 B1 1/2001 Hofbauer
6,178,735 B1 1/2001 Frutschi
6,179,446 B1 1/2001 Sarmadi
6,188,182 B1 2/2001 Nickols et al.
6,202,707 B1 3/2001 Woodall et al.
6,206,660 B1 3/2001 Coney et al.
6,210,131 B1 4/2001 Whitehead
6,216,462 B1 4/2001 Gray, Jr.
6,225,706 B1 5/2001 Keller
6,276,123 B1 8/2001 Chen et al.
6,327,858 B1 12/2001 Negre et al.
6,327,994 B1 12/2001 Labrador
6,349,543 B1 2/2002 Lisniansky
RE37,603 E 3/2002 Coney
6,352,576 B1 3/2002 Spencer et al.
6,360,535 B1 3/2002 Fisher
6,367,570 B1 4/2002 Long, III
6,372,023 B1 4/2002 Kiyono et al.
6,389,814 B2 5/2002 Viteri et al.
6,397,578 B2 6/2002 Tsukamoto
6,401,458 B2 6/2002 Jacobson
6,407,465 B1 6/2002 Peltz et al.
6,419,462 B1 7/2002 Horie et al.
6,422,016 B2 7/2002 Alkhamis
6,478,289 B1 11/2002 Trewin
6,512,966 B2 1/2003 Lof
6,513,326 B1 2/2003 Maceda et al.
6,516,615 B1 2/2003 Stockhausen et al.
6,516,616 B2 2/2003 Carver
6,598,392 B2 7/2003 Majeres
6,598,402 B2 7/2003 Kataoka et al.
6,606,860 B2 8/2003 McFarland
6,612,348 B1 9/2003 Wiley
6,619,930 B2 9/2003 Jansen et al.
6,626,212 B2 9/2003 Morioka et al.
6,629,413 B1 10/2003 Wendt et al.
6,637,185 B2 10/2003 Hatamiva et al.
6,652,241 B1 11/2003 Alder
6,652,243 B2 11/2003 Krasnov
6,666,024 B1 12/2003 Moskal
6,670,402 B1 12/2003 Lee et al.
6,672,056 B2 1/2004 Roth et al.
6,675,765 B2 1/2004 Endoh
6,688,108 B1 2/2004 Van Liere
6,698,472 B2 3/2004 Camacho et al.

6,711,984 B2 3/2004 Tagge et al.
6,712,166 B2 3/2004 Rush et al.
6,715,514 B2 4/2004 Parker, III
6,718,761 B2 4/2004 Merswolke et al.
6,739,131 B1 5/2004 Kershaw
6,739,419 B2 5/2004 Jain et al.
6,745,569 B2 6/2004 Gerdes
6,745,801 B1 6/2004 Cohen et al.
6,748,737 B2 6/2004 Lafferty
6,762,926 B1 7/2004 Shiue et al.
6,786,245 B1 9/2004 Eichelberger
6,789,387 B2 9/2004 Brinkman
6,789,576 B2 9/2004 Umetsu et al.
6,797,039 B2 9/2004 Spencer
6,815,840 B1 11/2004 Aldendeshe
6,817,185 B2 11/2004 Coney et al.
6,834,737 B2 12/2004 Bloxham
6,848,259 B2 2/2005 Keller-sornig
6,857,450 B2 2/2005 Rupp
6,886,326 B2 5/2005 Holtzapple et al.
6,892,802 B2 5/2005 Kelly et al.
6,900,556 B2 5/2005 Provanzana
6,922,991 B2 8/2005 Polcuch
6,925,821 B2 8/2005 Sienel
6,927,503 B2 8/2005 Enish et al.
6,931,848 B2 8/2005 Maceda et al.
6,935,096 B2 8/2005 Haiun
6,938,415 B2 9/2005 Last
6,938,654 B2 9/2005 Gershtein et al.
6,946,017 B2 9/2005 Leppin et al.
6,948,328 B2 9/2005 Kidwell
6,952,058 B2 10/2005 Mccoin
6,959,546 B2 11/2005 Corcoran
6,963,802 B2 11/2005 Enis
6,964,165 B2 11/2005 Uhl et al.
6,964,176 B2 11/2005 Kidwell
6,974,307 B2 12/2005 Antoune et al.
7,000,389 B2 2/2006 Lewellin
7,007,474 B1 3/2006 Ochs et al.
7,017,690 B2 3/2006 Burke
7,028,934 B2 4/2006 Burynski, Jr.
7,040,083 B2 5/2006 Horii et al.
7,040,108 B1 5/2006 Flammang
7,040,859 B2 5/2006 Kane
7,043,920 B2 5/2006 Viteri et al.
7,047,744 B1 5/2006 Robertson et al.
7,055,325 B2 6/2006 Wolken
7,067,937 B2 6/2006 Enish et al.
7,075,189 B2 7/2006 Heronemus
RE39,249 E 8/2006 Link, Jr.
7,084,520 B2 8/2006 Zambrano
7,086,231 B2 8/2006 Pinkerton
7,093,450 B2 8/2006 Jimenez Haertel et al.
7,093,626 B2 8/2006 Li et al.
7,098,552 B2 8/2006 Mccoin
7,107,766 B2 9/2006 Zacche' et al.
7,107,767 B2 9/2006 Frazer et al.
7,116,006 B2 10/2006 Mccoin
7,124,576 B2 10/2006 Cherney et al.
7,124,586 B2 10/2006 Neqre et al.
7,127,895 B2 10/2006 Pinkerton et al.
7,128,777 B2 10/2006 Spencer
7,134,279 B2 11/2006 White
7,155,912 B2 1/2007 Enis et al.
7,168,928 B1 1/2007 West
7,168,929 B2 1/2007 Siegel et al.
7,169,489 B2 1/2007 Redmond
7,177,751 B2 2/2007 Froloff
7,178,337 B2 2/2007 Pflanz
7,191,603 B2 3/2007 Taube
7,197,871 B2 4/2007 Yoshino
7,201,095 B2 4/2007 Hughey
7,218,009 B2 5/2007 Hendrickson et al.
7,219,779 B2 5/2007 Bauer et al.
7,225,762 B2 6/2007 Mahlanen
7,228,690 B2 6/2007 Barker
7,230,348 B2 6/2007 Poole
7,231,998 B1 6/2007 Schechter
7,240,812 B2 7/2007 Kamikozuru
7,249,617 B2 7/2007 Musselman et al.
7,254,944 B1 8/2007 Goetzinger et al.
7,273,122 B2 9/2007 Rose
7,281,371 B1 10/2007 Heidenreich et al.
7,308,361 B2 12/2007 Enis et al.
7,317,261 B2 1/2008 Rolt
7,322,377 B2 1/2008 Baltes
7,325,401 B1 2/2008 Kesseli et al.
7,328,575 B2 2/2008 Hedman
7,329,099 B2 2/2008 Hartman
7,347,049 B2 3/2008 Rajendran et al.
7,353,786 B2 4/2008 Scuderi et al.
7,353,845 B2 4/2008 Underwood et al.
7,354,252 B2 4/2008 Baatrup et al.
7,364,410 B2 4/2008 Lin, Jr.
7,392,871 B2 7/2008 Severinsky et al.
7,406,828 B1 8/2008 Nakhamkin
7,407,501 B2 8/2008 Zvuloni
7,415,835 B2 8/2008 Cowans et al.
7,415,995 B2 8/2008 Plummer et al.
7,417,331 B2 8/2008 De La Torre et al.
7,418,820 B2 9/2008 Harvey et al.
7,436,086 B2 10/2008 Mcclintic
7,441,399 B2 10/2008 Utamura
7,448,213 B2 11/2008 Mitani
7,453,164 B2 11/2008 Borden et al.
7,469,527 B2 12/2008 Neqre et al.
7,471,010 B1 12/2008 Fingersh
7,481,337 B2 1/2009 Luharuka et al.
7,488,159 B2 2/2009 Bhatt et al.
7,527,483 B1 5/2009 Glauber
7,579,700 B1 8/2009 Meller
7,603,970 B2 10/2009 Scuderi et al.
7,607,503 B1 10/2009 Schechter
7,693,402 B2 4/2010 Hudson et al.
7,802,426 B2 9/2010 Bollinger
7,827,787 B2 11/2010 Cherney et al.
7,832,207 B2 11/2010 McBride et al.
7,843,076 B2 11/2010 Gogoana et al.
7,874,155 B2 1/2011 McBride et al.
7,900,444 B1 3/2011 McBride et al.
7,958,731 B2 6/2011 McBride et al.
7,963,110 B2 6/2011 Bollinger et al.
2001/0045093 A1 11/2001 Jacobson
2003/0131599 A1 7/2003 Gerdes
2003/0145589 A1 8/2003 Tillyer
2003/0177767 A1 9/2003 Keller-sornig et al.
2003/0180155 A1 9/2003 Coney et al.
2004/0050042 A1 3/2004 Frazer
2004/0050049 A1 3/2004 Wendt et al.
2004/0146406 A1 7/2004 Last
2004/0146408 A1 7/2004 Anderson
2004/0148934 A1 8/2004 Pinkerton et al.
2004/0211182 A1 10/2004 Gould
2004/0244580 A1 12/2004 Coney et al.
2004/0261415 A1 12/2004 Negre et al.
2005/0016165 A1 1/2005 Enis et al.
2005/0028529 A1 2/2005 Bartlett et al.
2005/0047930 A1 3/2005 Schmid
2005/0072154 A1 4/2005 Frutschi
2005/0115234 A1 6/2005 Asano et al.
2005/0155347 A1 7/2005 Lewellin
2005/0166592 A1 8/2005 Larson et al.
2005/0274334 A1 12/2005 Warren
2005/0275225 A1 12/2005 Bertolotti
2005/0279086 A1 12/2005 Hoos
2005/0279292 A1 12/2005 Hudson et al.
2006/0055175 A1 3/2006 Grinblat
2006/0059936 A1 3/2006 Radke et al.
2006/0059937 A1 3/2006 Perkins et al.
2006/0075749 A1 4/2006 Cherney et al.
2006/0090467 A1 5/2006 Crow
2006/0090477 A1 5/2006 Rolff
2006/0107664 A1 5/2006 Hudson et al.
2006/0162543 A1 7/2006 Abe et al.
2006/0162910 A1 7/2006 Kelly et al.
2006/0175337 A1 8/2006 Defosset
2006/0201148 A1 9/2006 Zabtcioqlu
2006/0248886 A1 11/2006 Ma 2006/0248892 A1 11/2006 Ingersoll
2006/0254281 A1 11/2006 Badeer et al.
2006/0260311 A1 11/2006 Ingersoll
2006/0260312 A1 11/2006 Ingersoll
2006/0262465 A1 11/2006 Wiederhold
2006/0266034 A1 11/2006 Ingersoll
2006/0266035 A1 11/2006 Ingersoll et al.
2006/0266036 A1 11/2006 Ingersoll
2006/0266037 A1 11/2006 Ingersoll
2006/0280993 A1 12/2006 Keefer et al.
2006/0283967 A1 12/2006 Cho et al.
2007/0006586 A1 1/2007 Hoffman et al.
2007/0022754 A1 2/2007 Perkins et al.
2007/0022755 A1 2/2007 Pinkerton et al.
2007/0062194 A1 3/2007 Ingersoll
2007/0074533 A1 4/2007 Hugenroth et al.
2007/0095069 A1 5/2007 Joshi et al.
2007/0113803 A1 5/2007 Froloff et al.
2007/0116572 A1 5/2007 Barbu et al.
2007/0137595 A1 6/2007 Greenwell
2007/0151528 A1 7/2007 Hedman
2007/0158946 A1 7/2007 Annen et al.
2007/0181199 A1 8/2007 Weber
2007/0182160 A1 8/2007 Enis et al.
2007/0205298 A1 9/2007 Harrison et al.
2007/0234749 A1 10/2007 Enis et al.
2007/0243066 A1 10/2007 Baron
2007/0245735 A1 10/2007 Ashikian
2007/0258834 A1 11/2007 Froloff et al.
2008/0000436 A1 1/2008 Goldman
2008/0016868 A1 1/2008 Ochs et al.
2008/0047272 A1 2/2008 Schoell
2008/0050234 A1 2/2008 Ingersoll et al.
2008/0072870 A1 3/2008 Chomyszak et al.
2008/0087165 A1 4/2008 Wright et al.
2008/0104939 A1 5/2008 Hoffmann et al.
2008/0112807 A1 5/2008 Uphues et al.
2008/0127632 A1 6/2008 Finkenrath et al.
2008/0138265 A1 6/2008 Lackner et al.
2008/0155975 A1 7/2008 Brinkman
2008/0155976 A1 7/2008 Smith et al.
2008/0157528 A1 7/2008 Wang et al.
2008/0157537 A1 7/2008 Richard
2008/0164449 A1 7/2008 Gray et al.
2008/0185194 A1 8/2008 Leone
2008/0202120 A1 8/2008 Karyambas
2008/0211230 A1 9/2008 Gurin
2008/0228323 A1 9/2008 Laumer et al.
2008/0233029 A1 9/2008 Fan et al.
2008/0238105 A1 10/2008 Ortiz et al.
2008/0238187 A1 10/2008 Garnett et al.
2008/0250788 A1 10/2008 Nuel et al.
2008/0251302 A1 10/2008 Lynn et al.
2008/0272597 A1 11/2008 Althaus
2008/0272598 A1 11/2008 Nakhamkin
2008/0272605 A1 11/2008 Borden et al.
2008/0308168 A1 12/2008 O'Brien, II et al.
2008/0308270 A1 12/2008 Wilson
2008/0315589 A1 12/2008 Malmrup
2009/0000290 A1 1/2009 Brinkman
2009/0007558 A1 1/2009 Hall et al.
2009/0008173 A1 1/2009 Hall et al.
2009/0010772 A1 1/2009 Siemroth
2009/0020275 A1 1/2009 Neher et al.
2009/0021012 A1 1/2009 Stull et al.
2009/0056331 A1 3/2009 Zhao et al.
2009/0071153 A1 3/2009 Boyapati et al.
2009/0107784 A1 4/2009 Gabriel et al.
2009/0145130 A1 6/2009 Kaufman
2009/0158740 A1 6/2009 Littau et al.
2009/0178409 A1 7/2009 Shinnar
2009/0200805 A1 8/2009 Kim et al.
2009/0220364 A1 9/2009 Rigal et al.
2009/0229902 A1 9/2009 Stansbury, III
2009/0249826 A1 10/2009 Hugelman
2009/0282822 A1 11/2009 McBride et al.
2009/0282840 A1 11/2009 Chen et al.
2009/0294096 A1 12/2009 Mills et al.
2009/0301089 A1 12/2009 Bollinger
2009/0317267 A1 12/2009 Gill et al.
2009/0322090 A1 12/2009 Wolf
2010/0018196 A1 1/2010 Li et al.
2010/0077765 A1 4/2010 Japikse
2010/0089063 A1 4/2010 McBride et al.
2010/0133903 A1 6/2010 Rufer
2010/0139277 A1 6/2010 McBride et al.
2010/0193270 A1 8/2010 Deshaies et al.
2010/0199652 A1 8/2010 Lemofouet et al.
2010/0205960 A1 8/2010 McBride et al.
2010/0229544 A1 9/2010 Bollinger et al.
2010/0307156 A1 12/2010 Bollinger
2010/0326062 A1 12/2010 Fong et al.
2010/0326064 A1 12/2010 Fong et al.
2010/0326066 A1 12/2010 Fong et al.
2010/0326068 A1 12/2010 Fong et al.
2010/0326069 A1 12/2010 Fong et al.
2010/0326075 A1 12/2010 Fong et al.
2010/0329891 A1 12/2010 Fong et al.
2010/0329903 A1 12/2010 Fong et al.
2010/0329909 A1 12/2010 Fong et al.
2011/0023488 A1 2/2011 Fong et al.
2011/0023977 A1 2/2011 Fong et al.
2011/0030359 A1 2/2011 Fong et al.
2011/0030552 A1 2/2011 Fong et al.
2011/0056193 A1 3/2011 McBride et al.
2011/0056368 A1 3/2011 McBride et al.
2011/0061741 A1 3/2011 Ingersoll et al.
2011/0061836 A1 3/2011 Ingersoll et al.
2011/0062166 A1 3/2011 Ingersoll et al.
2011/0079010 A1 4/2011 McBride et al.
2011/0083438 A1 4/2011 McBride et al.
2011/0107755 A1 5/2011 McBride et al.
2011/0115223 A1 5/2011 Stahlkopf et al.
2011/0138797 A1 6/2011 Bollinger et al.
2011/0167813 A1 7/2011 McBride et al.
2011/0204064 A1 8/2011 Crane et al.
2011/0219760 A1 9/2011 McBride et al.
2011/0219763 A1 9/2011 McBride et al.
2011/0232281 A1 9/2011 McBride et al.
2011/0233934 A1 9/2011 Crane et al.

FOREIGN PATENT DOCUMENTS

BE 1008885 8/1996
CN 1061262 5/1992
CN 1171490 1/1998
CN 1276308 12/2000
CN 1277323 12/2000
CN 1412443 4/2003
CN 1743665 3/2006
CN 2821162 9/2006
CN 2828319 10/2006
CN 2828368 10/2006
CN 1884822 12/2006
CN 1888328 1/2007
CN 1967091 5/2007
CN 101033731 9/2007
CN 101042115 9/2007
CN 101070822 11/2007
CN 101149002 3/2008
CN 101162073 4/2008
CN 201103518 8/2008
CN 201106527 8/2008
CN 101289963 10/2008
CN 201125855 10/2008
CN 101377190 4/2009
CN 101408213 4/2009
CN 101435451 5/2009
DE 25 38 870 4/1976
DE 19530253 11/1996
DE 19903907 8/2000
DE 19911534 9/2000
DE 10042020 5/2001
DE 20118183 3/2003
DE 20120330 4/2003
DE 10147940 5/2003
DE 10205733 8/2003
DE 10212480 10/2003
DE 20312293 12/2003

| | | |
|---|---|---|
| DE | 10220499 | 4/2004 |
| DE | 10334637 | 2/2005 |
| DE | 10 2005 047622 | 4/2007 |
| EP | 0204748 | 3/1981 |
| EP | 0091801 | 10/1983 |
| EP | 0097002 | 12/1983 |
| EP | 0196690 | 10/1986 |
| EP | 0212692 | 3/1987 |
| EP | 0364106 | 4/1990 |
| EP | 0507395 | 10/1992 |
| EP | 0821162 | 1/1998 |
| EP | 0 857 877 | 8/1998 |
| EP | 1 388 442 | 2/2004 |
| EP | 1405662 | 4/2004 |
| EP | 1657452 | 5/2006 |
| EP | 1726350 | 11/2006 |
| EP | 1741899 | 1/2007 |
| EP | 1 780 058 | 5/2007 |
| EP | 1988294 | 11/2008 |
| EP | 2014896 | 1/2009 |
| EP | 2078857 | 7/2009 |
| FR | 2449805 | 9/1980 |
| FR | 2816993 | 5/2002 |
| FR | 2829805 | 3/2003 |
| GB | 722524 | 11/1951 |
| GB | 772703 | 4/1957 |
| GB | 1449076 | 9/1976 |
| GB | 1479940 | 7/1977 |
| GB | 2106992 | 4/1983 |
| GB | 2223810 | 4/1990 |
| GB | 2 300 673 | 11/1996 |
| GB | 2373546 | 9/2002 |
| GB | 2403356 | 12/2004 |
| JP | 57010778 | 1/1982 |
| JP | 57070970 | 5/1982 |
| JP | 57120058 | 7/1982 |
| JP | 58183880 | 10/1982 |
| JP | 58150079 | 9/1983 |
| JP | 58192976 | 11/1983 |
| JP | 60206985 | 10/1985 |
| JP | 62101900 | 5/1987 |
| JP | 63227973 | 9/1988 |
| JP | 2075674 | 3/1990 |
| JP | 2247469 | 10/1990 |
| JP | 3009090 | 1/1991 |
| JP | 3281984 | 12/1991 |
| JP | 4121424 | 4/1992 |
| JP | 6185450 | 7/1994 |
| JP | 8145488 | 6/1996 |
| JP | 9166079 | 6/1997 |
| JP | 10313547 | 11/1998 |
| JP | 2000-346093 | 6/1999 |
| JP | 11351125 | 12/1999 |
| JP | 2000166128 | 6/2000 |
| JP | 200346093 | 12/2000 |
| JP | 2002127902 | 5/2002 |
| JP | 2003083230 | 3/2003 |
| JP | 2005023918 | 1/2005 |
| JP | 2005036769 | 2/2005 |
| JP | 2005068963 | 3/2005 |
| JP | 2006220252 | 8/2006 |
| JP | 2007001872 | 1/2007 |
| JP | 2007145251 | 6/2007 |
| JP | 2007211730 | 8/2007 |
| JP | 2008038658 | 2/2008 |
| KR | 840000180 | 2/1984 |
| KR | 2004004637 | 1/2004 |
| RU | 2101562 | 1/1998 |
| RU | 2169857 | 6/2001 |
| RU | 2213255 | 9/2003 |
| SU | 800438 | 1/1981 |
| UA | 69030 | 8/2004 |
| WO | WO-82/000319 | 2/1982 |
| WO | WO-8802818 | 4/1988 |
| WO | WO-92/022741 | 12/1992 |
| WO | WO-93/006367 | 4/1993 |
| WO | WO-93/011363 | 6/1993 |
| WO | WO-93/024754 | 12/1993 |
| WO | WO 9412785 | 6/1994 |
| WO | WO-95/025381 | 9/1995 |
| WO | WO-96/001942 | 1/1996 |
| WO | WO-96/022456 | 7/1996 |
| WO | WO-96/034213 | 10/1996 |
| WO | WO-97/001029 | 1/1997 |
| WO | WO-97/17546 | 5/1997 |
| WO | WO-98/002818 | 1/1998 |
| WO | WO-98/017492 | 4/1998 |
| WO | WO-99/41498 | 8/1999 |
| WO | WO-00/01945 | 1/2000 |
| WO | WO-00/37800 | 6/2000 |
| WO | WO-00/65212 | 11/2000 |
| WO | WO-00/68578 | 11/2000 |
| WO | WO 0175290 | 10/2001 |
| WO | WO-02/25083 | 3/2002 |
| WO | WO-02/46621 | 6/2002 |
| WO | WO-02/103200 | 12/2002 |
| WO | WO-03/021702 | 3/2003 |
| WO | WO-03/078812 | 9/2003 |
| WO | WO-03/081011 | 10/2003 |
| WO | WO-2004/034391 | 5/2004 |
| WO | WO-2004/059155 | 7/2004 |
| WO | WO-2004/072452 | 8/2004 |
| WO | WO-2004/074679 | 9/2004 |
| WO | WO-2004/109172 | 12/2004 |
| WO | WO-2005/044424 | 5/2005 |
| WO | WO-2005/062969 | 7/2005 |
| WO | WO-2005/067373 | 7/2005 |
| WO | WO-2005/079461 | 9/2005 |
| WO | WO-2005/088131 | 9/2005 |
| WO | WO-2005/095155 | 10/2005 |
| WO | WO-2006/029633 | 3/2006 |
| WO | WO-2006/058085 | 6/2006 |
| WO | WO-2006/124006 | 11/2006 |
| WO | WO-2007/002094 | 1/2007 |
| WO | WO-2007/003954 | 1/2007 |
| WO | WO-2007/012143 | 2/2007 |
| WO | WO-2007/035997 | 4/2007 |
| WO | WO-2007/051034 | 5/2007 |
| WO | WO-2007/066117 | 6/2007 |
| WO | WO-2007/86792 | 8/2007 |
| WO | WO-2007/089872 | 8/2007 |
| WO | WO-2007/096656 | 8/2007 |
| WO | WO-2007/111839 | 10/2007 |
| WO | WO-2007/136765 | 11/2007 |
| WO | WO-2007140914 | 12/2007 |
| WO | WO-2008/003950 | 1/2008 |
| WO | WO-2008/014769 | 2/2008 |
| WO | WO-2008023901 | 2/2008 |
| WO | WO-2008/027259 | 3/2008 |
| WO | WO-2008/028881 | 3/2008 |
| WO | WO-2008/039725 | 4/2008 |
| WO | WO-2008/045468 | 4/2008 |
| WO | WO-2009045468 | 4/2008 |
| WO | WO-2008/051427 | 5/2008 |
| WO | WO-2008/074075 | 6/2008 |
| WO | WO-2008/084507 | 7/2008 |
| WO | WO-2008/091373 | 7/2008 |
| WO | WO 2008102292 | 8/2008 |
| WO | WO-2008/106967 | 9/2008 |
| WO | WO-2008/108870 | 9/2008 |
| WO | WO-2008/109006 | 9/2008 |
| WO | WO-2008/110018 | 9/2008 |
| WO | WO-2008/115479 | 9/2008 |
| WO | WO-2008/121378 | 10/2008 |
| WO | WO-2008139267 | 11/2008 |
| WO | WO-2008/152432 | 12/2008 |
| WO | WO-2008/153591 | 12/2008 |
| WO | WO-2008/157327 | 12/2008 |
| WO | WO-2009/034548 | 3/2009 |
| WO | WO-2009/038973 | 3/2009 |
| WO | WO-2009/044139 | 4/2009 |
| WO | WO-2009/045110 | 4/2009 |
| WO | WO-2009/114205 | 9/2009 |
| WO | WO-2009/126784 | 10/2009 |
| WO | WO-2010/006319 | 1/2010 |
| WO | WO-2010/009053 | 1/2010 |
| WO | WO-2010/105155 | 9/2010 |
| WO | WO-2010/135658 | 11/2010 |

| | | |
|---|---|---|
| WO | WO-2011/008321 | 1/2011 |
| WO | WO-2011/008325 | 1/2011 |
| WO | WO-2011/008500 | 1/2011 |

OTHER PUBLICATIONS

Rufer et al., "Energetic Performance of a Hybrid Energy Storage System Based on Compressed Air and Super Capacitors," Power Electronics, Electrical Drives, Automation and Motion, (May 1, 2006), pp. 469-474.

Lemofouet et al. "Hybrid Energy Storage Systems based on Compressed Air and Supercapacitors with Maximum Efficiency Point Tracking," Industrial Electronics Laboratory (LEI), (2005), pp. 1-10.

Lemofouet et al. "Hybrid Energy Storage Systems based on Compressed Air and Supercapacitors with Maximum Efficiency Point Tracking," the International Power Electronics Conference, (2005), pp. 461-468.

International Search Report and Written Opinion for International Application No. PCT/US2010/055279 mailed Jan. 24, 2011, 14 pages.

"Hydraulic Transformer Supplies Continuous High Pressure," Machine Design, Penton Media, vol. 64, No. 17, (Aug. 1992), 1 page.

Lemofouet, "Investigation and Optimisation of Hybrid Electricity Storage Systems Based on Compressed Air and Supercapacitors," (Oct. 20, 2006), 250 pages.

Cyphelly et al., "Usage of Compressed Air Storage Systems," BFE-Program "Electricity," Final Report, May 2004, 14 pages.

Lemofouet et al., "A Hybrid Energy Storage System Based on Compressed Air and Supercapacitors with Maximum Efficiency Point Tracking (MEPT)," IEEE Transactions on Industrial Electron, vol. 53, No. 4, (Aug. 2006) pp. 1105-1115.

International Search Report and Written Opinion issued Sep. 15, 2009 for International Application No. PCT/US2009/040027, 8 pages.

International Search Report and Written Opinion issued Aug. 30, 2010 for International Application No. PCT/US2010/029795, 9 pages.

International Search Report and Written Opinion issued Dec. 3, 2009 for International Application No. PCT/US2009/046725, 9 pages.

* cited by examiner

SYSTEMS AND METHODS FOR COMPRESSED-GAS ENERGY STORAGE USING COUPLED CYLINDER ASSEMBLIES

RELATED APPLICATIONS

This application is a continuation of U.S. patent application Ser. No. 12/938,853, filed on Nov. 3, 2010, which claims the benefit of and priority to U.S. Provisional Patent Application No. 61/257,583, filed Nov. 3, 2009; U.S. Provisional Patent Application No. 61/287,938, filed Dec. 18, 2009; U.S. Provisional Patent Application No. 61/310,070, filed Mar. 3, 2010; and U.S. Provisional Patent Application No. 61/375,398, filed Aug. 20, 2010, the entire disclosure of each of which is hereby incorporated herein by reference.

STATEMENT REGARDING FEDERALLY SPONSORED RESEARCH

This invention was made with government support under IIP-0810590 and IIP-0923633 awarded by the NSF. The government has certain rights in the invention.

FIELD OF THE INVENTION

In various embodiments, the present invention relates to pneumatics, power generation, and energy storage, and more particularly, to compressed-gas energy-storage systems and methods using pneumatic cylinders.

BACKGROUND

Storing energy in the form of compressed gas has a long history and components tend to be well tested, reliable, and have long lifetimes. The general principle of compressed-gas or compressed-air energy storage (CAES) is that generated energy (e.g., electric energy) is used to compress gas (e.g., air), thus converting the original energy to pressure potential energy; this potential energy is later recovered in a useful form (e.g., converted back to electricity) via gas expansion coupled to an appropriate mechanism. Advantages of compressed-gas energy storage include low specific-energy costs, long lifetime, low maintenance, reasonable energy density, and good reliability.

If a body of gas is at the same temperature as its environment, and expansion occurs slowly relative to the rate of heat exchange between the gas and its environment, then the gas will remain at approximately constant temperature as it expands. This process is termed "isothermal expansion. Isothermal expansion of a quantity of gas stored at a given temperature recovers approximately three times more work than would "adiabatic expansion, that is, expansion where no heat is exchanged between the gas and its environment, because the expansion happens rapidly or in an insulated chamber. Gas may also be compressed isothermally or adiabatically.

An ideally isothermal energy-storage cycle of compression, storage, and expansion would have 100% thermodynamic efficiency. An ideally adiabatic energy-storage cycle would also have 100% thermodynamic efficiency, but there are many practical disadvantages to the adiabatic approach. These include the production of higher temperature and pressure extremes within the system, heat loss during the storage period, and inability to exploit environmental (e.g., cogenerative) heat sources and sinks during expansion and compression, respectively. In an isothermal system, the cost of adding a heat-exchange system is traded against resolving the difficulties of the adiabatic approach. In either case, mechanical energy from expanding gas must usually be converted to electrical energy before use.

An efficient and novel design for storing energy in the form of compressed gas utilizing near isothermal gas compression and expansion has been shown and described in U.S. patent application Ser. Nos. 12/421,057 (the '057 application) and 12/639,703 (the '703 application), the disclosures of which are hereby incorporated herein by reference in their entireties. The '057 and '703 applications disclose systems and methods for expanding gas isothermally in staged hydraulic/pneumatic cylinders and intensifiers over a large pressure range in order to generate electrical energy when required. Mechanical energy from the expanding gas is used to drive a hydraulic pump/motor subsystem that produces electricity. Systems and methods for hydraulic-pneumatic pressure intensification that may be employed in systems and methods such as those disclosed in the '057 and '703 applications are shown and described in U.S. patent application Ser. No. 12/879,595 (the '595 application), the disclosure of which is hereby incorporated herein by reference in its entirety.

The ability of such systems to either store energy (i.e., use energy to compress gas into a storage reservoir) or produce energy (i.e., expand gas from a storage reservoir to release energy) will be apparent to any person reasonably familiar with the principles of electrical and pneumatic machines.

Various embodiments described in the '057 application involve several energy conversion stages: during compression, electrical energy is converted to rotary motion in an electric motor, then converted to hydraulic fluid flow in a hydraulic pump, then converted to linear motion of a piston in a hydraulic-pneumatic cylinder assembly, then converted to mechanical potential energy in the form of compressed gas. Conversely, during retrieval of energy from storage by gas expansion, the potential energy of pressurized gas is converted to linear motion of a piston in a hydraulic-pneumatic cylinder assembly, then converted to hydraulic fluid flow through a hydraulic motor to produce rotary mechanical motion, then converted to electricity using a rotary electric generator.

However, such energy storage and recovery systems would be more directly applicable to a wide variety of applications if they converted the work done by the linear piston motion directly into electrical energy or into rotary motion via mechanical means (or vice versa). In such ways, the overall efficiency and cost-effectiveness of the compressed air system may be increased.

SUMMARY

Embodiments of the present invention obviate the need for a hydraulic subsystem by converting the reciprocal motion of energy storage and recovery cylinders into electrical energy via alternative means. In some embodiments, the invention combines a compressed-gas energy storage system with a linear-generator system for the generation of electricity from reciprocal motion to increase system efficiency and cost-effectiveness. The same arrangement of devices can be used to convert electric energy to potential energy in compressed gas, with similar gains in efficiency and cost-effectiveness.

Another alternative, utilized in various embodiments, to the use of hydraulic fluid to transmit force between the motor/generator and the gas undergoing compression or expansion is the mechanical transmission of the force. In particular, the linear motion of the cylinder piston or pistons may be coupled to a crankshaft or other means of conversion to rotary motion. The crankshaft may in turn be coupled to, e.g., a gear box or a continuously variable transmission (CVT) that drives the shaft of an electric motor/generator at a rotational speed higher than that of the crankshaft. The continuously variable transmission, within its operable range of effective gear ratios, allows the motor/generator to be operated at constant speed regardless of crankshaft speed. The motor/generator operating point can be chosen for optimal efficiency; constant output power is also desirable. Multiple pistons may be coupled to a single crankshaft, which may be advantageous for purposes of shaft balancing.

In addition, energy storage and generation systems in accordance with embodiments of the invention may include a heat-transfer subsystem for expediting heat transfer in one or more compartments of the cylinder assembly. In one embodiment, the heat-transfer subsystem includes a fluid circulator and a heat-transfer fluid reservoir as described in the '703 application. The fluid circulator pumps a heat-transfer fluid into the first compartment and/or the second compartment of the pneumatic cylinder. The heat-transfer subsystem may also include a spray mechanism, disposed in the first compartment and/or the second compartment, for introducing the heat-transfer fluid. In various embodiments, the spray mechanism is a spray head and/or a spray rod.

Gas undergoing expansion tends to cool, while gas undergoing compression tends to heat. To maximize efficiency (i.e., the fraction of elastic potential energy in the compressed gas that is converted to work, or vice versa), gas expansion and compression should be as near isothermal (i.e., constant-temperature) as possible. Several ways of approximating isothermal expansion and compression may be employed.

First, as described in the '703 application, droplets of a liquid (e.g., water) may be sprayed into a chamber of the pneumatic cylinder in which gas is presently undergoing compression (or expansion) in order to transfer heat to or from the gas. As the liquid droplets exchange heat with the gas around them, the temperature of the gas is raised or lowered; the temperature of the droplets is also raised or lowered. The liquid is evacuated from the cylinder through a suitable mechanism. The heat-exchange spray droplets may be introduced through a spray head (in, e.g., a vertical cylinder), through a spray rod arranged coaxially with the cylinder piston (in, e.g., a horizontal cylinder), or by any other mechanism that permits formation of a liquid spay within the cylinder. Droplets may be used to either warm gas undergoing expansion or to cool gas undergoing compression. An isothermal process may be approximated via judicious selection of this heat-exchange rate.

Furthermore, as described in U.S. Pat. No. 7,802,426 (the '426 patent), the disclosure of which is hereby incorporated by reference herein in its entirety, gas undergoing either compression or expansion may be directed, continuously or in installments, through a heat-exchange subsystem external to the cylinder. The heat-exchange subsystem either rejects heat to the environment (to cool gas undergoing compression) or absorbs heat from the environment (to warm gas undergoing expansion). Again, an isothermal process may be approximated via judicious selection of this heat-exchange rate.

As mentioned above, some embodiments of the present invention utilize a linear motor/generator as an alternative to the conventional rotary motor/generator. Like a rotary motor/generator, a linear motor/generator, when operated as a generator, converts mechanical power to electrical power by exploiting Faraday's law of induction: that is, the magnetic flux through a closed circuit is made to change by moving a magnet, thus inducing an electromotive force (EMF) in the circuit. The same device may also be operated as a motor.

There are several forms of linear motor/generator, but for simplicity, the discussion herein mainly pertains to the permanent-magnet tubular type. In some applications tubular linear generators have advantages over flat topologies, including smaller leakage, smaller coils with concomitant lower conductor loss and higher force-to-weight ratio. For brevity, only operation in generator mode is described herein. The ability of such a machine to operate as either a motor or generator will be apparent to any person reasonably familiar with the principles of electrical machines.

In a typical tubular linear motor/generator, permanent radially-magnetized magnets, sometimes alternated with iron core rings, are affixed to a shaft. The permanent magnets have alternating magnetization. This armature, composed of shaft and magnets, is termed a translator or mover and moves axially through a tubular winding or stator. Its function is analogous to that of a rotor in a conventional generator. Moving the translator through the stator in either direction produces a pulse of alternating EMF in the stator coil. The tubular linear generator thus produces electricity from a source of reciprocating motion. Moreover, such generators offer the translation of such mechanical motion into electrical energy with high efficiency, since they obviate the need for gear boxes or other mechanisms to convert reciprocal into rotary motion. Since a linear generator produces a series of pulses of alternating current (AC) power with significant harmonics, power electronics are typically used to condition the output of such a generator before it is fed to the power grid. However, such power electronics require less maintenance and are less prone to failure than the mechanical linear-to-rotary conversion systems which would otherwise be required. Operated as a motor, such a tubular linear motor/generator produces reciprocating motion from an appropriate electrical excitation.

In a compressed-gas energy storage system, gas is stored at high pressure (e.g., approximately 3000 pounds per square inch gauge (psig)). This gas is expanded into a chamber containing a piston or other mechanism that separates the gas on one side of the chamber from the other, preventing gas movement from one chamber to the other while allowing the transfer of force/pressure from one chamber to the next. This arrangement of chambers and piston (or other mechanism) is herein termed a "pneumatic cylinder or "cylinder. The term "cylinder is not, however, limited to vessels that are cylindrical in shape (i.e., having a circular cross-section); rather, a cylinder merely defines a sealed volume and may have a cross-section of any arbitrary shape that may or may not vary through the volume. The shaft of the cylinder may be attached to a mechanical load, e.g., the translator of a linear generator. In the simplest arrangement, the cylinder shaft and translator are in line (i.e., aligned on a common axis). In some embodiments, the shaft of the cylinder is coupled to a transmission mechanism for converting a reciprocal motion of the shaft into a rotary motion, and a motor/generator is coupled to the transmission mechanism. In some embodiments, the transmission mechanism includes a crankshaft and a gear box. In other embodiments, the transmission mechanism includes a crankshaft and a CVT. A CVT is a transmission that can move smoothly through a continuum of effective gear ratios over some finite range.

In the type of compressed-gas storage system described in the '057 application, reciprocal motion is produced during recovery of energy from storage by expansion of gas in pneumatic cylinders. In various embodiments, this reciprocal motion is converted to rotary motion by first using the expanding gas to drive a pneumatic/hydraulic intensifier; the hydraulic fluid pressurized by the intensifier drives a hydraulic rotary motor/generator to produce electricity. (The system is run in reverse to convert electric energy into potential energy in compressed gas.) By mechanically coupling linear generators to pneumatic cylinders, the hydraulic system may be omitted, typically with increased efficiency and reliability. Conversely, a linear motor/generator may be operated as a motor in order to compress gas in pneumatic cylinders for storage in a reservoir. In this mode of operation, the device converts electrical energy to mechanical energy rather than the reverse. The potential advantages of using a linear electrical machine may thus accrue to both the storage and recovery operations of a compressed-gas energy storage system.

In various embodiments, the compression and expansion occurs in multiple stages, using low- and high-pressure cylinders. For example, in expansion, high-pressure gas is expanded in a high-pressure cylinder from a maximum pressure (e.g., approximately 3,000 psig) to some mid-pressure (e.g. approximately 300 psig); then this mid-pressure gas is further expanded further (e.g., approximately 300 psig to approximately 30 psig) in a separate low-pressure cylinder. Thus, a high-pressure cylinder may handle a maximum pressure up to approximately a factor of ten greater than that of a low-pressure cylinder. Furthermore, the ratio of maximum to minimum pressure handled by a high-pressure cylinder may be approximately equal to ten (or even greater), and/or may be approximately equal to such a ratio of the low-pressure cylinder. The minimum pressure handled by a high-pressure cylinder may be approximately equal to the maximum pressure handled by a low-pressure cylinder.

The two stages may be tied to a common shaft and driven by a single linear motor/generator (or may be coupled to a common crankshaft, as detailed below). When each piston reaches the limit of its range of motion (e.g., reaches the end of the low-pressure side of the chamber), valves or other mechanisms may be adjusted to direct gas to the appropriate chambers. In double-acting devices of this type, there is no withdrawal stroke or unpowered stroke: the stroke is powered in both directions.

Since a tubular linear generator is inherently double-acting (i.e., generates power regardless of which way the translator moves), the resulting system generates electrical power at all times other than when the piston is hesitating between strokes. Specifically, the output of the linear generator may be a series of pulses of AC power, separated by brief intervals of zero power output during which the mechanism reverses its stroke direction. Power electronics may be employed with short-term energy storage devices such as ultracapacitors to condition this waveform to produce power acceptable for the grid. Multiple units operating out-of-phase may also be used to minimize the need for short-term energy storage during the transition periods of individual generators.

Use of a CVT enables the motor/generator to be operated at constant torque and speed over a range of crankshaft rotational velocities. The resulting system generates electrical power continuously and at a fixed output level as long as pressurized air is available from the reservoir. As mentioned above, power electronics and short-term energy storage devices such as ultracapacitors may, if needed, condition the waveform produced by the motor/generator to produce power acceptable for the grid.

In various embodiments, the system also includes a source of compressed gas and a control-valve arrangement for selectively connecting the source of compressed gas to an input of the first compartment (or "chamber) of the pneumatic cylinder assembly and an input of the second compartment of the pneumatic cylinder assembly. The system may also include a second pneumatic cylinder assembly having a first compartment and a second compartment separated by a piston slidably disposed within the cylinder and a shaft coupled to the piston and extending through at least one of the first compartment and the second compartment of the second cylinder and beyond an end cap of the second cylinder and coupled to a transmission mechanism. The second pneumatic cylinder assembly may be fluidly coupled to the first pneumatic cylinder assembly. For example, the pneumatic cylinder assemblies may be coupled in series. Additionally, one of the pneumatic cylinder assemblies may be a high-pressure cylinder and the other pneumatic cylinder assembly may be a low-pressure cylinder. The low-pressure cylinder assembly may be volumetrically larger, e.g., may have an interior volume at least 50% larger, than the high-pressure cylinder assembly.

A further opportunity for increased efficiency arises from the fact that as gas in the high-pressure storage vessel is exhausted, its pressure decreases. Thus, in order to extract as much energy as possible from a given quantity of stored gas, the electricity-producing side of such an energy-storage system must operate over a wide range of input pressures, i.e., from the reservoir's high-pressure limit (e.g., approximately 3,000 psig) to as close to atmospheric pressure as possible. At lower pressure, gas expanding in a cylinder exerts a smaller force on its piston and thus on the translator of the linear generator (or to the rotor of the generator) to which it is coupled. For a fixed piston speed, this generally results in reduced power output.

In preferred embodiments, however, power output is substantially constant. Constant power may be maintained with decreased force by increasing piston linear speed. Piston speed may be regulated, for example, by using power electronics to adjust the electrical load on a linear generator so that translator velocity is increased (with correspondingly higher voltage and lower current induced in the stator) as the pressure of the gas in the high-pressure storage vessel decreases. At lower gas-reservoir pressures, in such an arrangement, the pulses of AC power produced by the linear generator will be shorter in duration and higher in frequency, requiring suitable adjustments in the power electronics to continue producing grid-suitable power.

With variable linear motor/generator speed, efficiency gains may be realized by using variable-pitch windings and/or a switched-reluctance linear generator. In a switched-reluctance generator, the mover (i.e., translator or rotor) contains no permanent magnets; rather, magnetic fields are induced in the mover by windings in the stator which are controlled electronically. The position of the mover is either measured or calculated, and excitement of the stator windings is electronically adjusted in real time to produce the desired torque (or traction) for any given mover position and velocity.

Substantially constant power may also be achieved by mechanical linkages which vary the torque for a given force. Other techniques include piston speed regulation by using power electronics to adjust the electrical load on the motor/generator so that crankshaft velocity is increased, which for a fixed torque will increase power. For such arrangements using power electronics, the center frequency and harmonics of the AC waveform produced by the motor/generator typically change, which may require suitable adjustments in the power electronics to continue producing grid-suitable power.

Use of a CVT to couple a crankshaft to a motor/generator is yet another way to achieve approximately constant power output in accordance with embodiments of the invention. Generally, there are two challenges to the maintenance of constant output power. First is the discrete piston stroke. As a quantity of gas is expanded in a cylinder during the course of a single stroke, its pressure decreases; to maintain constant power output from the cylinder as the force acting on its piston decreases, the piston's linear velocity is continually increased throughout the stroke. This increases the crankshaft angular velocity proportionately throughout the stroke. To maintain constant angular velocity and constant power at the input shaft of the motor/generator throughout the stroke, the effective gear ratio of the CVT is adjusted continuously to offset increasing crankshaft speed.

Second, pressure in the main gas store decreases as the store is exhausted. As this occurs, the piston velocity at all points along the stroke is typically increased to deliver constant power. Crankshaft angular velocity is therefore also typically increased at all times.

Under these illustrative conditions, the effective gear ratio of the CVT that produces substantially constant output power, plotted as a function of time, has the approximate form of a periodic sawtooth (corresponding to CVT adjustment during each discrete stroke) superimposed on a ramp (corresponding to CVT adjustment compensating for exhaustion of the gas store.)

With either a linear or rotary motor/generator, the range of forces (and thus of speeds) is generally minimized in order to achieve maximize efficiency. In lieu of more complicated linkages, for a given operating pressure range (e.g., from approximately 3,000 psig to approximately 30 psig), the range of forces (torques) seen at the motor/generator may be reduced through the addition of multiple cylinder stages arranged, e.g., in series. That is, as gas from the high-pressure reservoir is expanded in one chamber of an initial, high-pressure cylinder, gas from the other chamber is directed to the expansion chamber of a second, lower-pressure cylinder. Gas from the lower-pressure chamber of this second cylinder may either be vented to the environment or directed to the expansion chamber of a third cylinder operating at still lower pressure, and so on. An arrangement using two cylinder assemblies is shown and described; however, the principle may be extended to more than two cylinders to suit a particular application.

For example, a narrower force range over a given range of reservoir pressures is achieved by having a first, high-pressure cylinder operating between approximately 3,000 psig and approximately 300 psig and a second, larger-volume, low-pressure cylinder operating between approximately 300 psig and approximately 30 psig. The range of pressures (and thus of force) is reduced as the square root, from 100:1 to 10:1, compared to the range that would be realized in a single cylinder operating between approximately 3,000 psig and approximately 30 psig. The square-root relationship between the two-cylinder pressure range and the single-cylinder pressure range can be demonstrated as follows.

A given pressure range $R_1$ from high pressure $P_H$ to low pressure $P_L$, namely $R_1=P_H/P_L$, is subdivided into two pressure ranges of equal magnitude $R_2$. The first range is from $P_H$ down to some intermediate pressure $P_I$ and the second is from $P_I$ down to $P_L$. Thus, $R_2=P_H/P_I=P_I/P_L$. From this identity of ratios, $P_I=(P_HP_L)^{1/2}$. Substituting for $P_I$ in $R_2=P_H/P_I$, we obtain $R_2=P_H/(P_HP_L)^{1/2}=(P_HP_L)^{1/2}=R_1^{1/2}$. It may be similarly shown that with appropriate cylinder sizing, the addition of a third cylinder/stage reduces the operating pressure range as the cube root, and so forth. In general (and as also set forth in the '595 application), N appropriately sized cylinders reduce an original (i.e., single-cylinder) operating pressure range $R_1$ to $R_1^{1/N}$. Any group of N cylinders staged in this manner, where $N \geqq 2$, is herein termed a cylinder group.

In various embodiments, the shafts of two or more double-acting cylinders are connected either to separate linear motor/generators or to a single linear motor/generator, either in line or in parallel. If they are connected in line, their common shaft may be arranged in line with the translator of a linear motor/generator. If they are connected in parallel, their separate shafts may be linked to a transmission (e.g., rigid beam) that is orthogonal to the shafts and to the translator of the motor/generator. Another portion of the beam may be attached to the translator of a linear generator that is aligned in parallel with the two cylinders. The synchronized reciprocal motion of the two double-acting cylinders may thus be transmitted to the linear generator.

In other embodiments of the invention, two or more cylinder groups, which may be identical, may be coupled to a common crankshaft. A crosshead arrangement may be used for coupling each of the N pneumatic cylinder shafts in each cylinder group to the common crankshaft. The crankshaft may be coupled to an electric motor/generator either directly or via a gear box. If the crankshaft is coupled directly to an electric motor/generator, the crankshaft and motor/generator may turn at very low speed (very low revolutions per minute, RPM), e.g., 25-30 RPM, as determined by the cycle speed of the cylinders.

Any multiple-cylinder implementation of this invention such as that described above may be co-implemented with any of the heat-transfer mechanisms described earlier.

All of the mechanisms described herein for converting potential energy in compressed gas to electrical energy, including the heat-exchange mechanisms and power electronics described, can, if appropriately designed, be operated in reverse to store electrical energy as potential energy in a compressed gas. Since this will be apparent to any person reasonably familiar with the principles of electrical machines, power electronics, pneumatics, and the principles of thermodynamics, the operation of these mechanisms to store energy rather than to recover it from storage will not be described. Such operation is, however, contemplated and within the scope of the invention and may be straightforwardly realized without undue experimentation.

In one aspect, embodiments of the invention feature an energy storage and generation system including or consisting essentially of a first pneumatic cylinder assembly, a motor/generator outside the first cylinder assembly, and a transmission mechanism coupled to the first cylinder assembly and the motor/generator. The first pneumatic cylinder assembly typically has first and second compartments separated by a piston, and the piston is typically coupled to the transmission mechanism. The transmission mechanism converts reciprocal motion of the piston into rotary motion of the motor/generator and/or converts rotary motion of the motor/generator into reciprocal motion of the piston.

Embodiments of the invention may include one or more of the following, in any of a variety of combinations. The system may include a shaft having a first end coupled to the piston and a second end coupled to the transmission mechanism. The second end of the shaft may be coupled to the transmission mechanism by a crosshead linkage. The piston may be slidably disposed within the cylinder. The system may include a container for compressed gas and an arrangement for selectively permitting fluid communication of the container for compressed gas with the first and/or second compartments of the pneumatic cylinder assembly. A second pneumatic cylinder assembly, which may include first and second compartments separated by a piston, may be coupled to the transmission mechanism and/or fluidly coupled to the first pneumatic cylinder assembly. The first and second pneumatic cylinder assemblies may be coupled in series. The first pneumatic cylinder assembly may be a high-pressure cylinder and the second pneumatic cylinder assembly may be a low-pressure cylinder. The second pneumatic cylinder assembly may be volumetrically larger (e.g., have a volume larger by at least 50%) than the first pneumatic cylinder assembly. The second pneumatic cylinder assembly may include a second shaft having a first end coupled to the piston and a second end coupled to the transmission mechanism. The second end of the second shaft may be coupled to the transmission mechanism by a crosshead linkage.

The transmission mechanism may include or consist essentially of, e.g., a crankshaft, a crankshaft and a gear box, or a crankshaft and a continuously variable transmission. The system may include a heat-transfer subsystem for expediting heat transfer in the first and/or second compartment of the first pneumatic cylinder assembly. The heat-transfer subsystem may include a fluid circulator for pumping a heat-transfer fluid into the first and/or second compartment of the first pneumatic cylinder assembly. One or more mechanisms for introducing the heat-transfer fluid (e.g., a spray head and/or a spray rod) may be disposed in the first and/or second compartment of the first pneumatic cylinder assembly. The transmission mechanism may vary torque for a given force exerted thereon, and/or the system may include power electronics for adjusting the load on the motor/generator.

In another aspect, embodiments of the invention feature an energy storage and generation system including or consisting essentially of a plurality of groups of pneumatic cylinder assemblies, a motor/generator outside the plurality of groups of pneumatic cylinder assemblies, and a transmission mechanism coupled to each of the cylinder assemblies and to the motor/generator. The transmission mechanism converts reciprocal motion into rotary motion of the motor/generator and/or converts rotary motion of the motor/generator into reciprocal motion. Each group of assemblies includes at least first and second pneumatic cylinder assemblies that are out of phase with respect to each other, and the first pneumatic cylinder assemblies of at least two of the groups are out of phase with respect to each other. Each pneumatic cylinder assembly may include a shaft having a first end coupled to a piston slidably disposed within the cylinder assembly and a second end coupled to the transmission mechanism (e.g., by a crosshead linkage).

Embodiments of the invention may include one or more of the following features in any of a variety of combinations. The transmission mechanism may include or consist essentially of a crankshaft, a crankshaft and a gear box, or a crankshaft and a continuously variable transmission. The system may include a heat-transfer subsystem for expediting heat transfer in the first and/or second compartment of each pneumatic cylinder assembly. The heat-transfer subsystem may include a fluid circulator for pumping a heat-transfer fluid into the first and/or second compartment of each pneumatic cylinder assembly. One or more mechanisms for introducing the heat-transfer fluid (e.g., a spray head and/or a spray rod) may be disposed in the first and/or second compartment of each pneumatic cylinder assembly.

In yet another aspect, embodiments of the invention feature a method for energy storage and recovery including expanding and/or compressing a gas via reciprocal motion, the reciprocal motion arising from or being converted into rotary motion, and exchanging heat with the gas during the expansion and/or compression in order to maintain the gas at a substantially constant temperature. The reciprocal motion may arise from or be converted into rotary motion of a motor/generator, thereby consuming or generating electricity. The reciprocal motion may arise from or be converted into rotary motion by a transmission mechanism, e.g., a crankshaft, a crankshaft and a gear box, or a crankshaft and a continuously variable transmission.

In a further aspect, embodiments of the invention feature an energy storage and generation system including or consisting essentially of a first pneumatic cylinder assembly coupled to a linear motor/generator. The first pneumatic cylinder assembly may include or consist essentially of first and second compartments separated by a piston. The piston may be slidably disposed within the cylinder assembly. The linear motor/generator directly converts reciprocal motion of the piston into electricity and/or directly converts electricity into reciprocal motion of the piston. The system may include a shaft having a first send coupled to the piston and a second end coupled to the mobile translator of the linear motor/generator. The shaft and the linear motor/generator may be aligned on a common axis.

Embodiments of the invention may include one or more of the following features in any of a variety of combinations. The system may include a second pneumatic cylinder assembly that includes or consists essentially of first and second compartments and a piston. The piston may be slidably disposed within the cylinder assembly. The piston may separate the compartments and/or may be coupled to the linear generator. The second pneumatic cylinder assembly may be connected in series pneumatically and in parallel mechanically with the first pneumatic cylinder assembly. The second pneumatic cylinder assembly may be connected in series pneumatically and in series mechanically with the first pneumatic cylinder assembly.

The system may include a heat-transfer subsystem for expediting heat transfer in the first and/or second compartment of the first pneumatic cylinder assembly. The heat-transfer subsystem may include a fluid circulator for pumping a heat-transfer fluid into the first and/or second compartment of the first pneumatic cylinder assembly. One or more mechanisms for introducing the heat-transfer fluid (e.g., a spray head and/or a spray rod) may be disposed in the first and/or second compartment of the first pneumatic cylinder assembly. The system may include a mechanism for increasing the speed of the piston as the pressure in the first and/or second compartment decreases. The mechanism may include or consist essentially of power electronics for adjusting the load on the linear motor/generator. The linear motor/generator may have variable-pitch windings. The linear motor/generator may be a switched-reluctance linear motor/generator.

These and other objects, along with advantages and features of the invention, will become more apparent through reference to the following description, the accompanying drawings, and the claims. Furthermore, it is to be understood that the features of the various embodiments described herein are not mutually exclusive and can exist in various combinations and permutations. Herein, the terms "liquid and "water interchangeably connote any mostly or substantially incompressible liquid, the terms "gas and "air are used interchangeably, and the term "fluid may refer to a liquid or a gas unless otherwise indicated. As used herein, the term "substantially means ±10%, and, in some embodiments, ±5%. A "valve is any mechanism or component for controlling fluid communication between fluid paths or reservoirs, or for selectively permitting control or venting.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

In the following description, various embodiments of the present invention are described with reference to the following drawings, in which.

DETAILED DESCRIPTION

Figure 1:
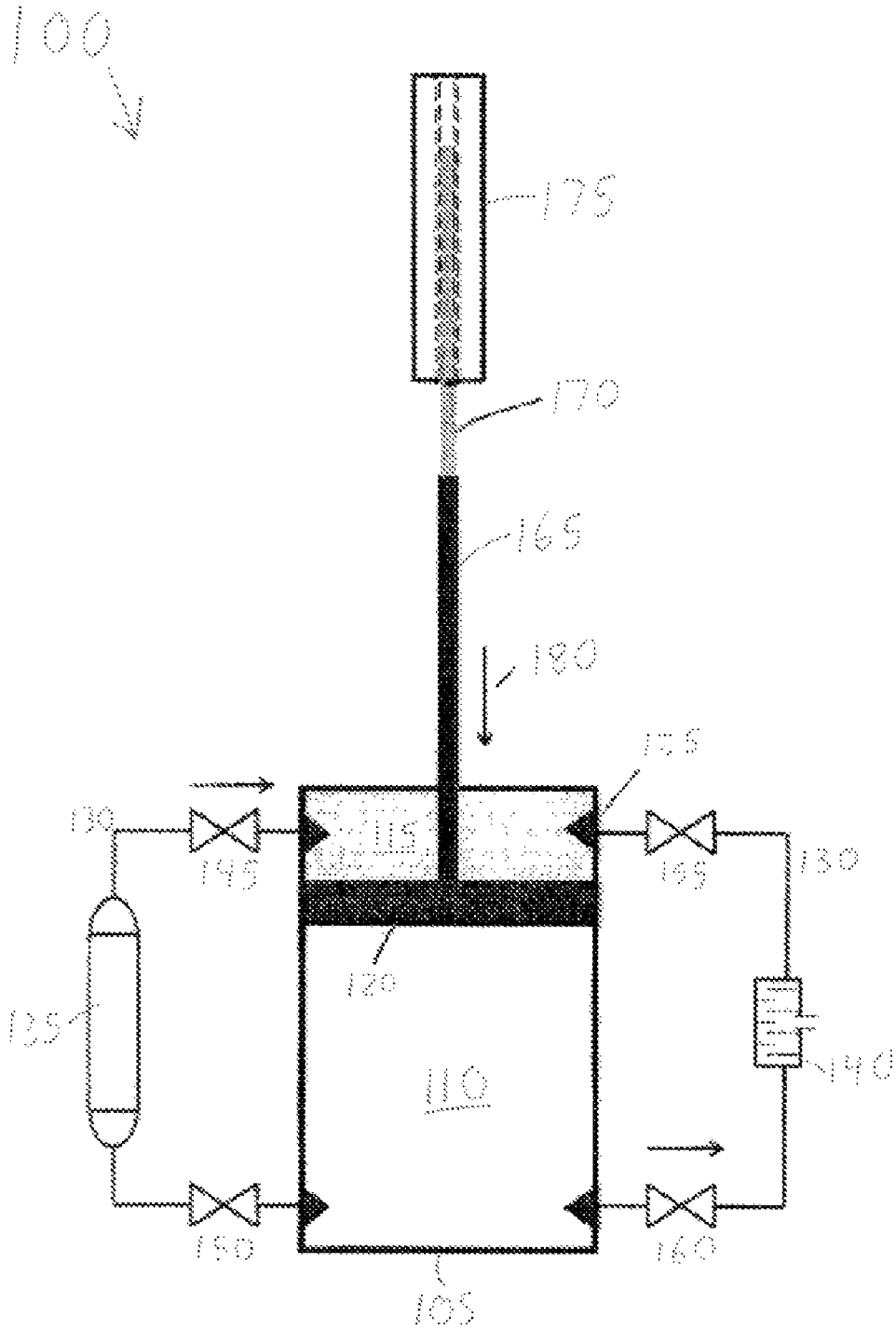
FIG. 1 is a schematic cross-sectional diagram showing the use of pressurized stored gas to operate a double-acting pneumatic cylinder and a linear motor/generator to produce electricity or stored pressurized gas according to various embodiments of the invention.

FIG. 1 illustrates the use of pressurized stored gas to operate a double-acting pneumatic cylinder and linear motor/generator to produce electricity according to a first illustrative embodiment of the invention. If the linear motor/generator is operated as a motor rather than as a generator, the identical mechanism employs electricity to produce pressurized stored gas. FIG. 1 shows the mechanism being operated to produce electricity from stored pressurized gas.

The illustrated energy storage and recovery system 100 includes a pneumatic cylinder 105 divided into two compartments 110 and 115 by a piston (or other mechanism) 120. The cylinder 105, which is shown in a vertical orientation in FIG. 1 but may be arbitrarily oriented, has one or more gas circulation ports 125 (only one is explicitly labeled), which are connected via piping 130 to a compressed-gas reservoir 135 and a vent 140. Note that as used herein the terms "pipe, "piping and the like refer to one or more conduits capable of carrying gas or liquid between two points. Thus, the singular term should be understood to extend to a plurality of parallel conduits where appropriate.

The piping 130 connecting the compressed-gas reservoir 135 to compartments 110, 115 of the cylinder 105 passes through valves 145, 150. Compartments 110, 115 of the cylinder 105 are connected to vent 140 through valves 155, 160. A shaft 165 coupled to the piston 120 is coupled to one end of a translator 170 of a linear electric motor/generator 175.

Figure 2:
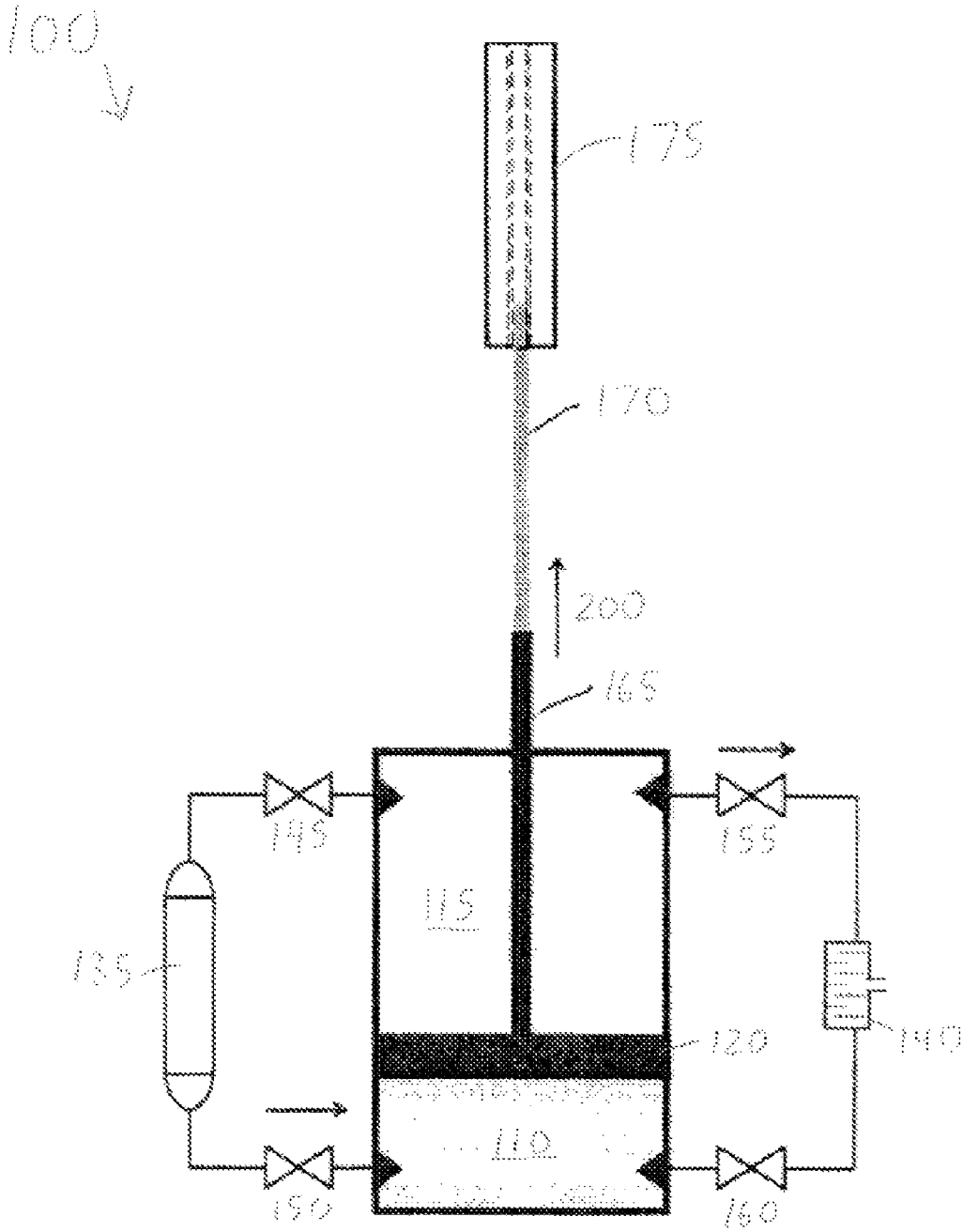
FIG. 2 depicts the mechanism of FIG. 1 in a different phase of operation (i.e., with the high- and low-pressure sides of the piston reversed and the direction of shaft motion reversed)

System 100 is shown in two operating states, namely (a) valves 145 and 160 open and valves 150 and 155 closed (shown in FIG. 1), and (b) valves 145 and 160 closed and valves 150 and 155 open (shown in FIG. 2). In state (a), high-pressure gas flows from the high-pressure reservoir 135 through valve 145 into compartment 115 (where it is represented by a gray tone in FIG. 1). Lower-pressure gas is vented from the other compartment 110 via valve 160 and vent 140. The result of the net force exerted on the piston 120 by the pressure difference between the two compartments 110, 115 is the linear movement of piston 120, piston shaft 165, and translator 170 in the direction indicated by the arrow 180, causing an EMF to be induced in the stator of the linear motor/generator 175. Power electronics are typically connected to the motor/generator 175, and may be software-controlled. Such power electronics are conventional and not shown in FIG. 1 or in subsequent figures.

FIG. 2 shows system 100 in a second operating state, the above-described state (b) in which valves 150 and 155 are open and valves 145 and 160 are closed. In this state, gas flows from the high-pressure reservoir 135 through valve 150 into compartment 110. Lower-pressure gas is vented from the other compartment 115 via valve 155 and vent 140. The result is the linear movement of piston 120, piston shaft 165, and translator 170 in the direction indicated by the arrow 200, causing an EMF to be induced in the stator of the linear motor/generator 175.

Figure 3:
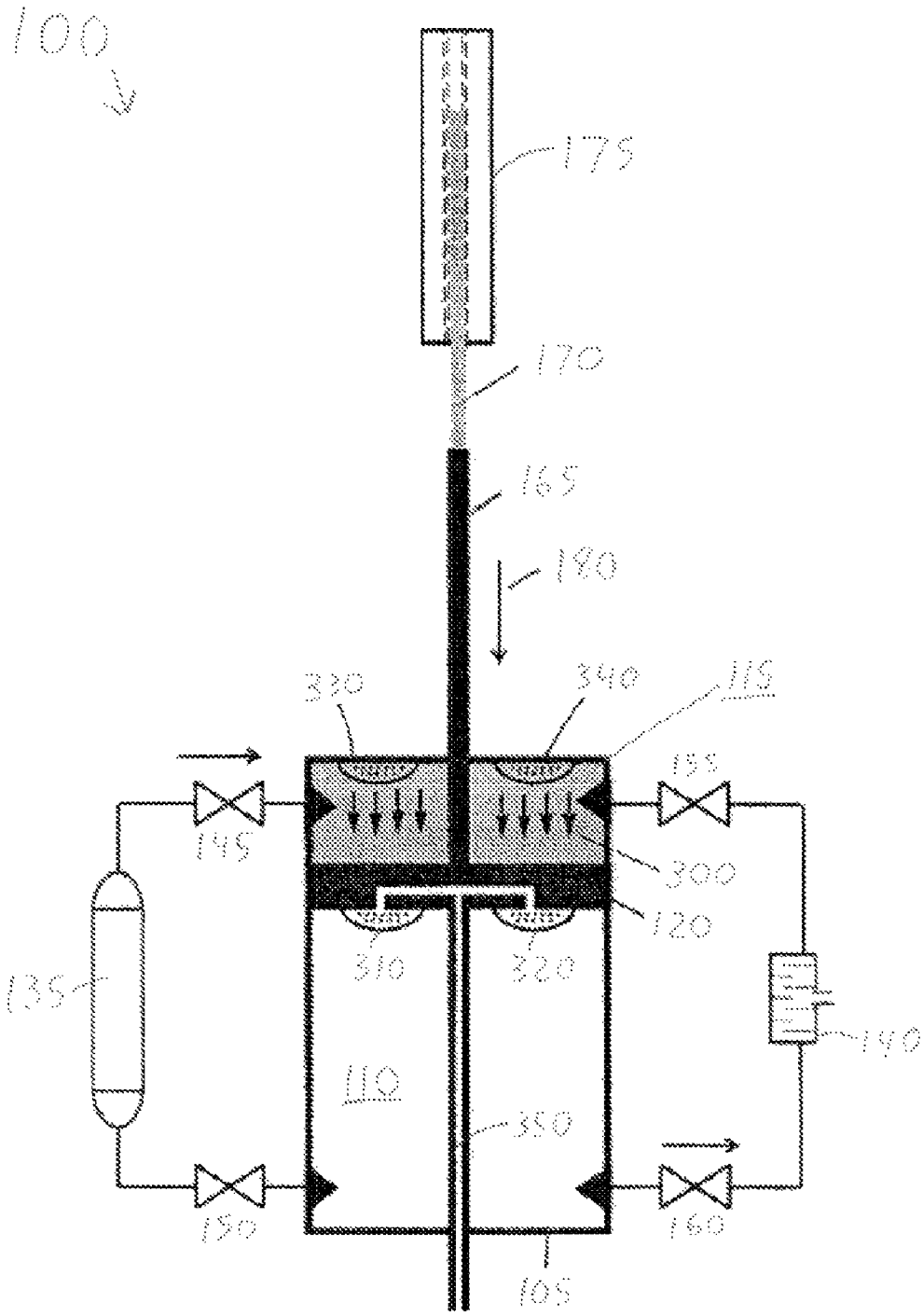
FIG. 3 depicts the arrangement of FIG. 1 modified to introduce liquid sprays into the two compartments of the cylinder, in accordance with various embodiments of the invention.

FIG. 3 illustrates the addition of expedited heat transfer by a liquid spray as described in, e.g., the '703 application. In this illustrative embodiment, a spray of droplets of liquid (indicated by arrows 300) is introduced into either compartment (or both compartments) of the cylinder 105 through perforated spray heads 310, 320, 330, and 340. The arrangement of spray heads shown is illustrative only; any suitable number and disposition of spray heads inside the cylinder 105 may be employed. Liquid may be conveyed to spray heads 310 and 320 on the piston 120 by a center-drilled channel 350 in the piston shaft 165, and may be conveyed to spray heads 330 and 340 by appropriate piping (not shown). Liquid flow to the spray heads is typically controlled by an appropriate valve system (not shown).

FIG. 3 depicts system 100 in the first of the two above-described operating states, where valves 145 and 160 are open and valves 150 and 155 are closed. In this state, gas flows from the high-pressure reservoir 135 through valve 145 into compartment 115. Liquid at a temperature higher than that of the expanding gas is sprayed into compartment 115 from spray heads 330, 340, and heat flows from the droplets to the gas. With suitable liquid temperature and flow rate, this arrangement enables substantially isothermal expansion of the gas in compartment 115.

Lower-pressure gas is vented from the other compartment 110 via valve 160 and vent 140, resulting in the linear movement of piston 120, piston shaft 165, and translator 170 in the downward direction (arrow 180). Since the expansion of the gas in compartment 115 is substantially isothermal, more mechanical work is performed on the piston 120 by the expanding gas and more electric energy is produced by the linear motor/generator 175 than would be produced by adiabatic expansion in system 100 of a like quantity of gas.

Figure 4:
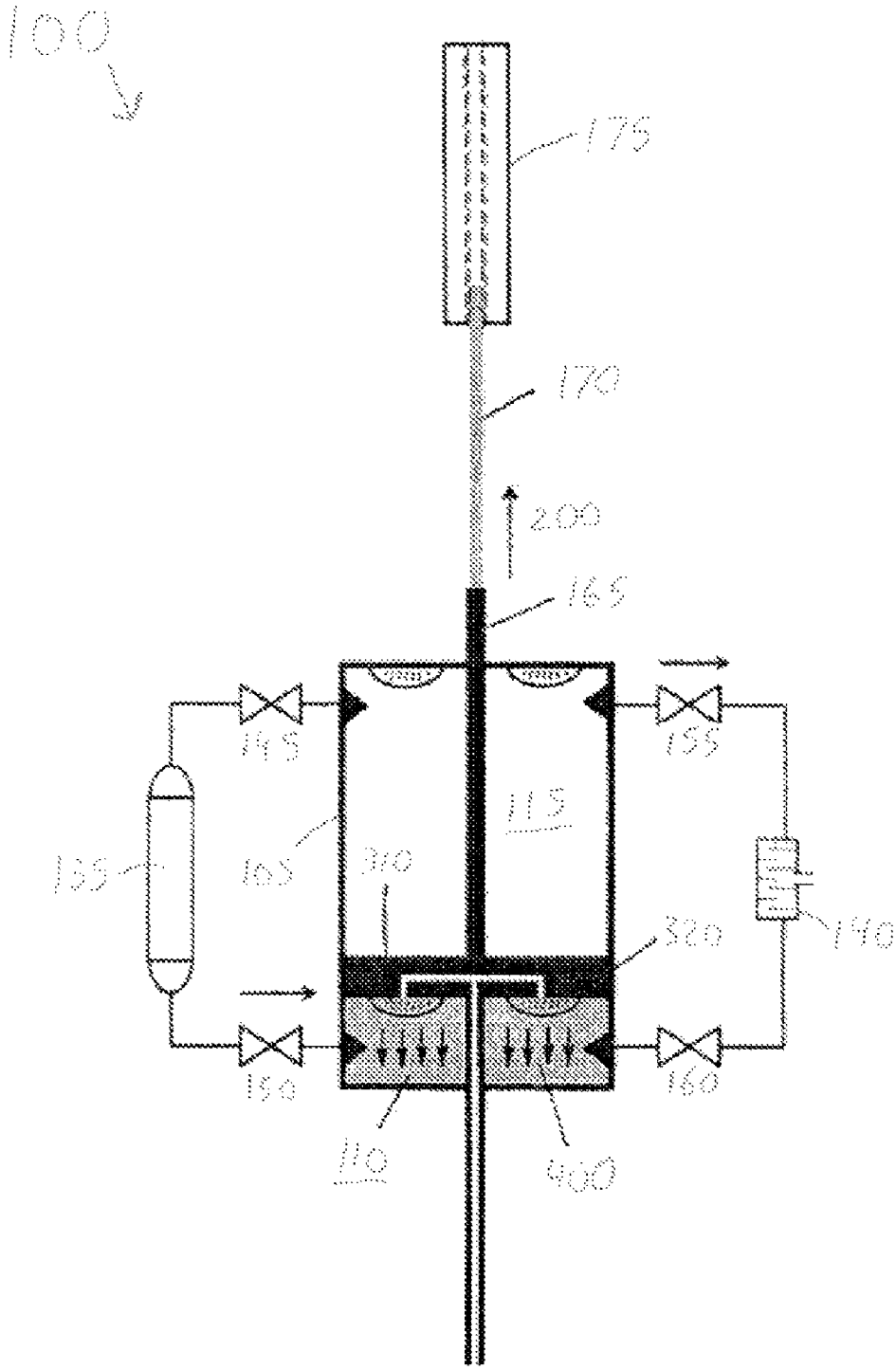
FIG. 4 depicts the mechanism of FIG. 3 in a different phase of operation (i.e., with the high- and low-pressure sides of the piston reversed and the direction of shaft motion reversed)

FIG. 4 shows the illustrative embodiment of FIG. 3 in a second operating state, where valves 150 and 155 are open and valves 145 and 160 are closed. In this state, gas flows from the high-pressure reservoir 135 through valve 150 into compartment 110. Liquid at a temperature higher than that of the expanding gas is sprayed (indicated by arrows 400) into compartment 110 from spray heads 310 and 320, and heat flows from the droplets to the gas. With suitable liquid temperature and flow rate, this arrangement enables the substantially isothermal expansion of the gas in compartment 110. Lower-pressure gas is vented from the other compartment 110 via valve 155 and vent 140. The result is the linear movement of piston 120, piston shaft 165, and translator 170 in the upward direction (arrow 200), generating electricity.

System 100 may be operated in reverse, in which case the linear motor/generator 175 operates as an electric motor. The droplet spray mechanism is used to cool gas undergoing compression (achieving substantially isothermal compression) for delivery to the storage reservoir rather than to warm gas undergoing expansion from the reservoir. System 100 may thus operate as a full-cycle energy storage system with high efficiency.

Additionally, the spray-head-based heat transfer illustrated in FIGS. 3 and 4 for vertically oriented cylinders may be replaced or augmented with a spray-rod heat transfer scheme for arbitrarily oriented cylinders as described in the '703 application.

Figure 5:
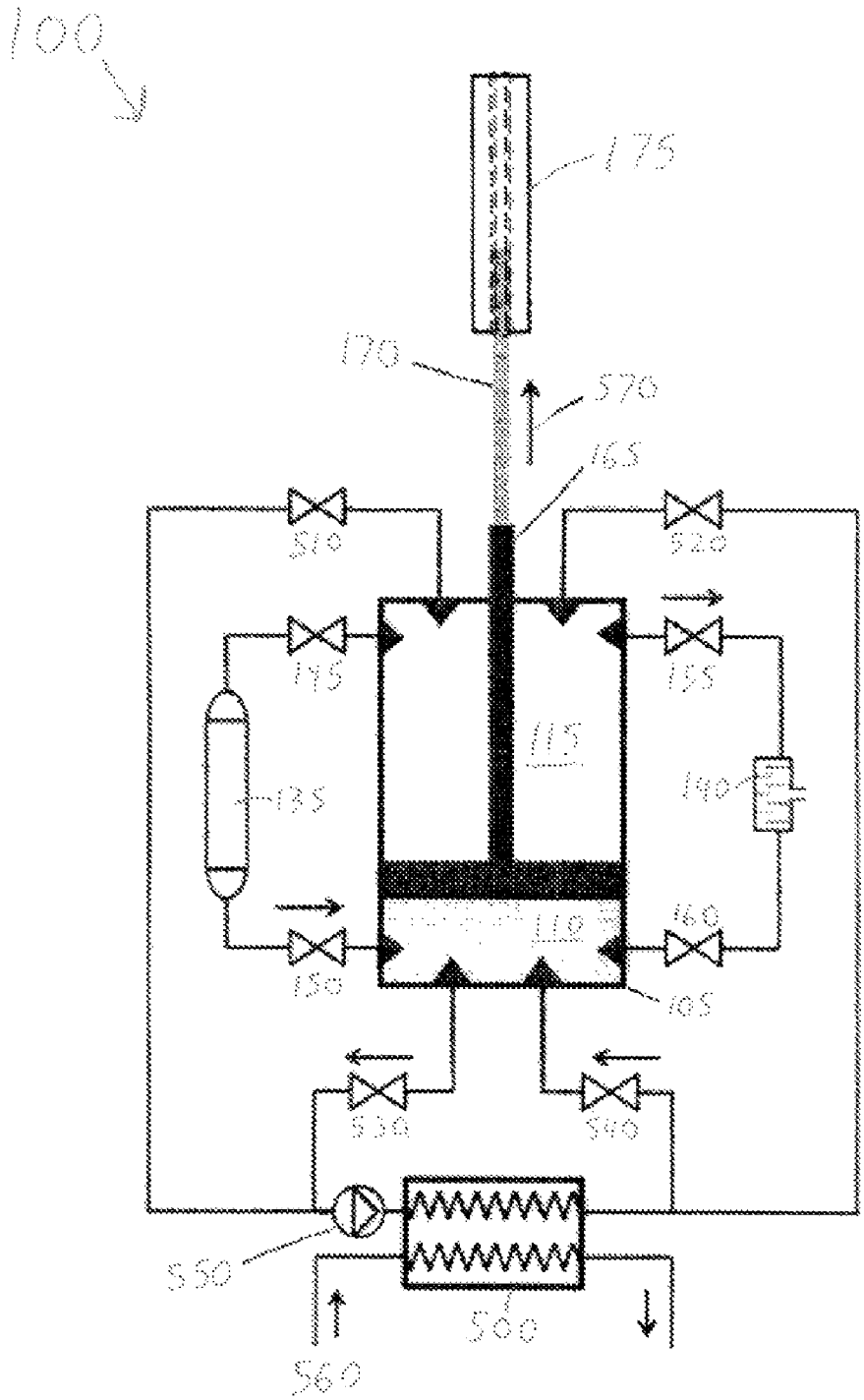
FIG. 5 depicts the mechanism of FIG. 1 modified by the addition of an external heat exchanger in communication with both compartments of the cylinder, where the contents of either compartment may be circulated through the heat exchanger to transfer heat to or from the gas as it expands or compresses, enabling substantially isothermal expansion or compression of the gas, in accordance with various embodiments of the invention.

FIG. 5 is a schematic of system 100 with the addition of expedited heat transfer by a heat-exchange subsystem that includes an external heat exchanger 500 connected by piping through valves 510, 520 to chamber 115 of the cylinder 105 and by piping through valves 530, 540 to chamber 110 of the cylinder 105. A circulator 550, which is preferably capable of pumping gas at high pressure (e.g., approximately 3,000 psi), drives gas through one side of the heat exchanger 500, either continuously or in installments. An external system, not shown, drives a fluid 560 (e.g., air, water, or another fluid) from an independent source through the other side of the heat exchanger.

The heat-exchange subsystem, which may include heat exchanger 500, circulator 550, and associated piping, valves, and ports, transfers gas from either chamber 110, 115 (or both chambers) of the cylinder 105 through the heat exchanger 500. The subsystem has two operating states, either (a) valves 145, 160, 510, and 520 closed and valves 150, 155, 530, and 540 open, or (b) valves 145, 160, 510, 520 open and valves 150, 155, 530, and 540 closed. FIG. 5 depicts state (a), in which high-pressure gas is conveyed from the reservoir 135 to chamber 110 of the cylinder 105; meanwhile, low-pressure gas is exhausted from chamber 115 via valve 155 to the vent 140. High-pressure gas is also circulated from chamber 110 through valve 530, circulator 550, heat exchanger 500, and valve 540 (in that order) back to chamber 110. Simultaneously, fluid 560 warmer than the gas flowing through the heat exchanger is circulated through the other side of the heat exchanger 500. With suitable temperature and flow rate of fluid 560 through the external side of the heat exchanger 500 and suitable flow rate of high-pressure gas through the cylinder side of the heat exchanger 500, this arrangement enables the substantially isothermal expansion of the gas in compartment 110.

In FIG. 5, the piston shaft 165 and linear motor/generator translator 170 are moving in the direction shown by the arrow 570. It should be clear that, like the illustrative embodiment shown in FIG. 1, the embodiment shown in FIG. 5 has a second operating state (not shown), defined by the second of the two above-described valve arrangements ("state (b) above), in which the direction of piston/translator motion is reversed. Moreover, this identical mechanism may clearly be operated in reverse—in that mode (not shown), the linear motor/generator 175 operates as an electric motor and the heat exchanger 500 cools gas undergoing compression (achieving substantially isothermal compression) for delivery to the storage reservoir 135 rather than warming gas undergoing expansion. Thus, system 100 may operate as a full-cycle energy storage system with high efficiency.

Figure 6:
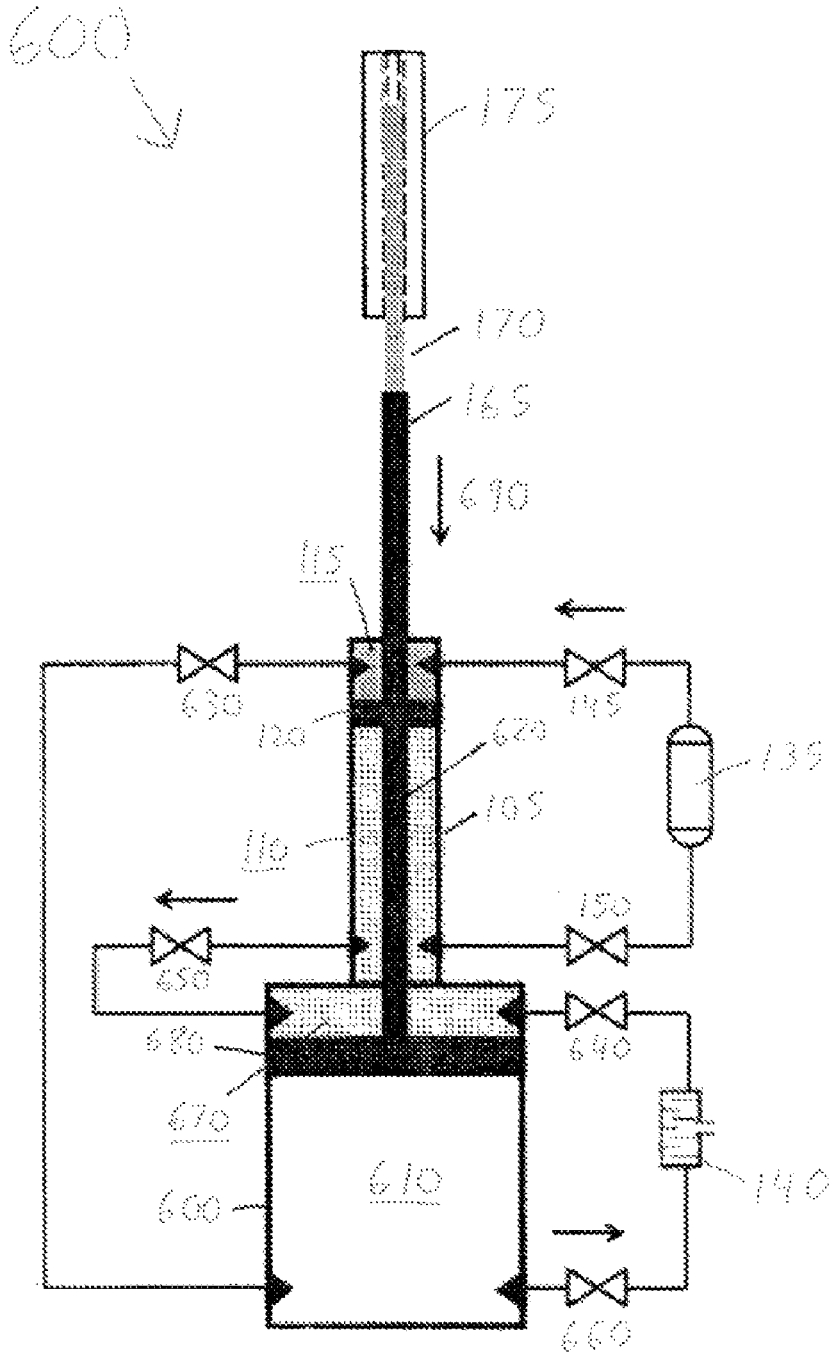
FIG. 6 depicts the mechanism of FIG. 1 modified by the addition of a second pneumatic cylinder operating at a lower pressure than the first, in accordance with various embodiments of the invention.

FIG. 6 depicts a system 600 that includes a second pneumatic cylinder 600 operating at a pressure lower than that of the first cylinder 105. Both cylinders 105, 600 are, in this embodiment, double-acting. They are connected in series (pneumatically) and in line (mechanically). Pressurized gas from the reservoir 135 drives the piston 120 of the double-acting high-pressure cylinder 105. Series attachment of the two cylinders directs gas from the lower-pressure compartment of the high-pressure cylinder 105 to the higher-pressure compartment of the low-pressure cylinder 600. In the operating state depicted in FIG. 6, gas from the lower-pressure side 610 of the low-pressure cylinder 600 exits through vent 140. Through their common piston shaft 620, 165, the two cylinders act jointly to move the translator 170 of the linear motor/generator 175. This arrangement reduces the range of pressures over which the cylinders jointly operate, as described above.

Figure 7:
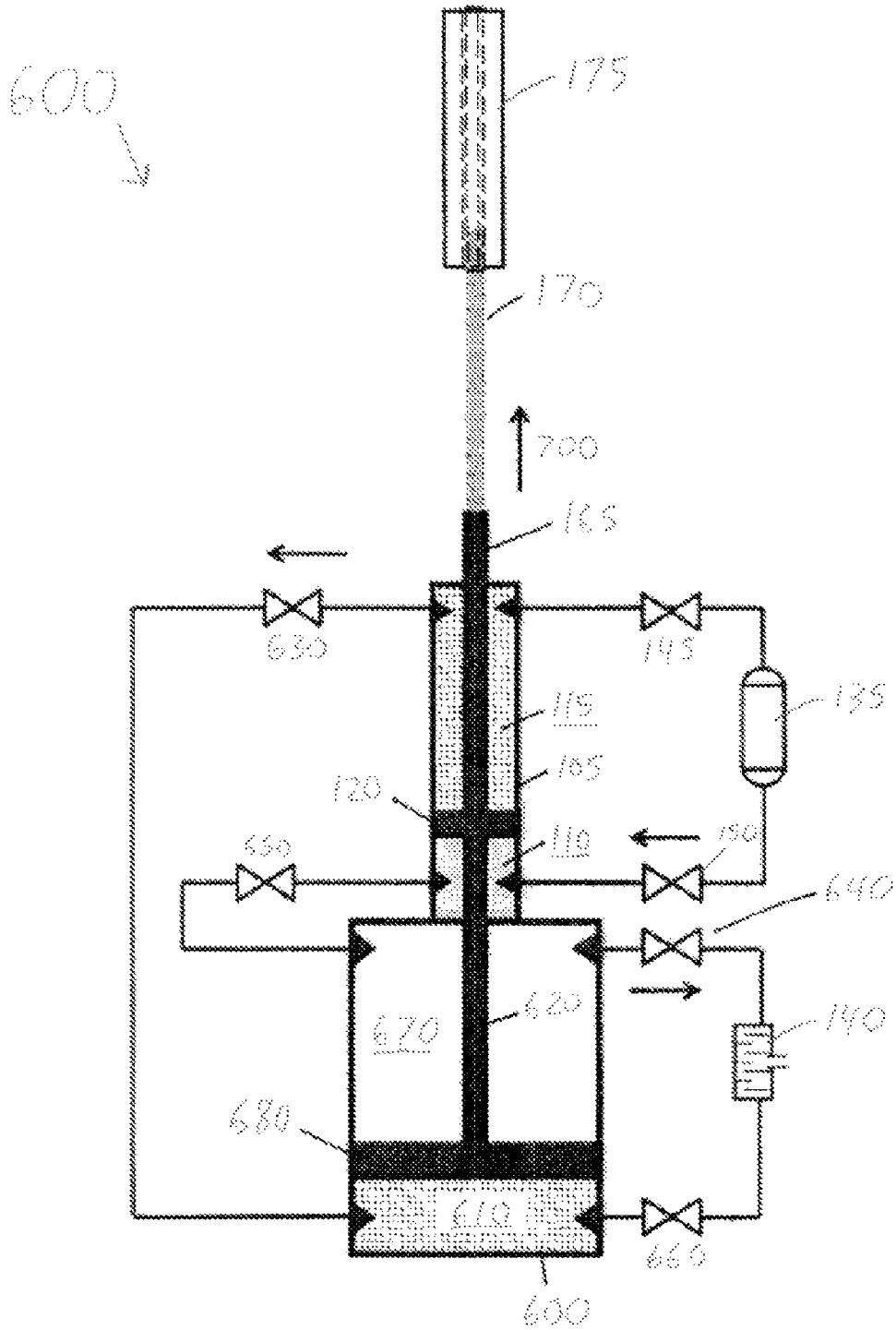
FIG. 7 depicts the mechanism of FIG. 6 in a different phase of operation (i.e., with the high- and low-pressure sides of the pistons reversed and the direction of shaft motion reversed)

System 600 is shown in two operating states, (a) valves 150, 630, and 640 closed and valves 145, 650, and 660 open (depicted in FIG. 6), and (b) valves 150, 630, and 640 open and valves 145, 650, and 660 closed (depicted in FIG. 7). FIG. 6 depicts state (a), in which gas flows from the high-pressure reservoir 135 through valve 145 into compartment 115 of the high-pressure cylinder 105. Intermediate-pressure gas (indicated by the stippled areas in the figure) is directed from compartment 110 of the high-pressure cylinder 105 by piping through valve 650 to compartment 670 of the low-pressure cylinder 600. The force of this intermediate-pressure gas on the piston 680 acts in the same direction (i.e., in the direction indicated by the arrow 690) as that of the high-pressure gas in compartment 115 of the high-pressure cylinder 105. The cylinders thus act jointly to move their common piston shaft 620, 165 and the translator 170 of the linear motor/generator 175 in the direction indicated by arrow 690, generating electricity during the stroke. Low-pressure gas is vented from the low-pressure cylinder 600 through the vent 140 via valve 660.

FIG. 7 shows the second operating state (b) of system 600. Valves 150, 630, and 640 are open and valves 145, 650, and 660 are closed. In this state, gas flows from the high-pressure reservoir 135 through valve 150 into compartment 110 of the high-pressure cylinder 105. Intermediate-pressure gas is directed from the other compartment 115 of the high-pressure cylinder 105 by piping through valve 630 to compartment 610 of the low-pressure cylinder 600. The force of this intermediate-pressure gas on the piston 680 acts in the same direction (i.e., in direction indicated by the arrow 700) as that of the high-pressure gas in compartment 110 of the high-pressure cylinder 105. The cylinders thus act jointly to move the common piston shaft 620, 165 and the translator 170 of the linear motor/generator 175 in the direction indicated by arrow 700, generating electricity during the stroke, which is in the direction opposite to that shown in FIG. 6. Low-pressure gas is vented from the low-pressure cylinder 600 through the vent 140 via valve 640.

The spray arrangement for heat exchange shown in FIGS. 3 and 4 or, alternatively (or in addition to), the external heat-exchanger arrangement shown in FIG. 5 (or another heat-exchange mechanism) may be straightforwardly adapted to the system 600 of FIGS. 6 and 7, enabling substantially isothermal expansion of the gas in the high-pressure reservoir 135. Moreover, system 600 may be operated as a compressor (not shown) rather than as a generator. Finally, the principle of adding cylinders operating at progressively lower pressures in series (pneumatic) and in line (mechanically) may involve three or more cylinders rather than merely two cylinders as shown in the illustrative embodiment of FIGS. 6 and 7.

Figure 8:
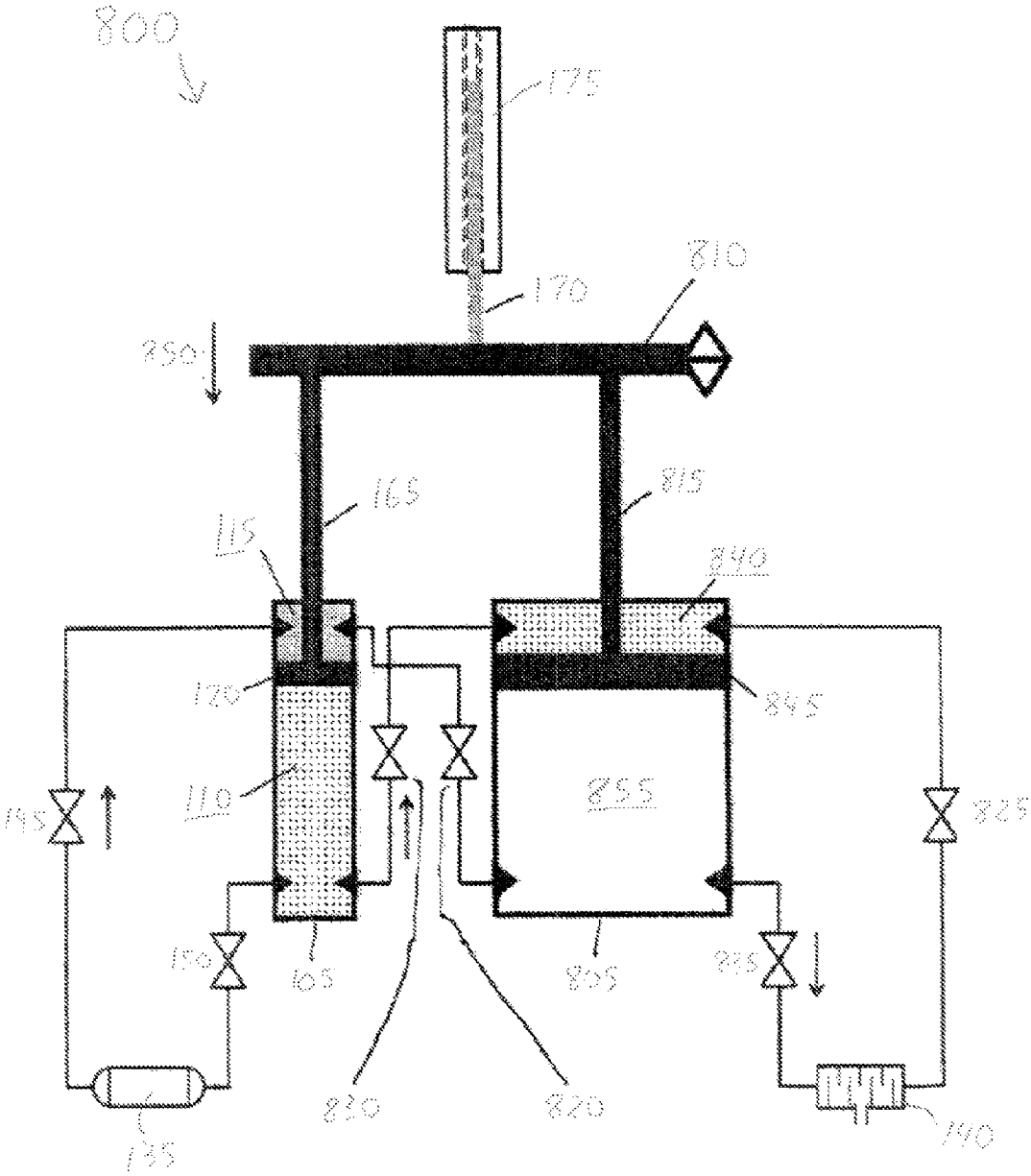
FIG. 8 depicts the mechanism of FIG. 1 modified by the addition a second pneumatic cylinder operating at lower pressure, in accordance with various embodiments of the invention.

FIG. 8 depicts an energy storage and recovery system 800 with a second pneumatic cylinder 805 operating at a lower pressure than the first cylinder 105. Both cylinders 105, 805 are double-acting. They are attached in series (pneumatically) and in parallel (mechanically). Pressurized gas from the reservoir 135 drives the piston 120 of the double-acting high-pressure cylinder 105. Series pneumatic attachment of the two cylinders is as detailed above with reference to FIGS. 6 and 7. Gas from the lower-pressure side of the low-pressure cylinder 805 is directed to vent 140. Through a common beam 810 coupled to the piston shafts 165, 815 of the cylinders, the cylinders act jointly to move the translator 170 of the linear motor/generator 175. This arrangement reduces the operating range of cylinder pressures as compared to a similar arrangement employing only one cylinder.

Figure 9:
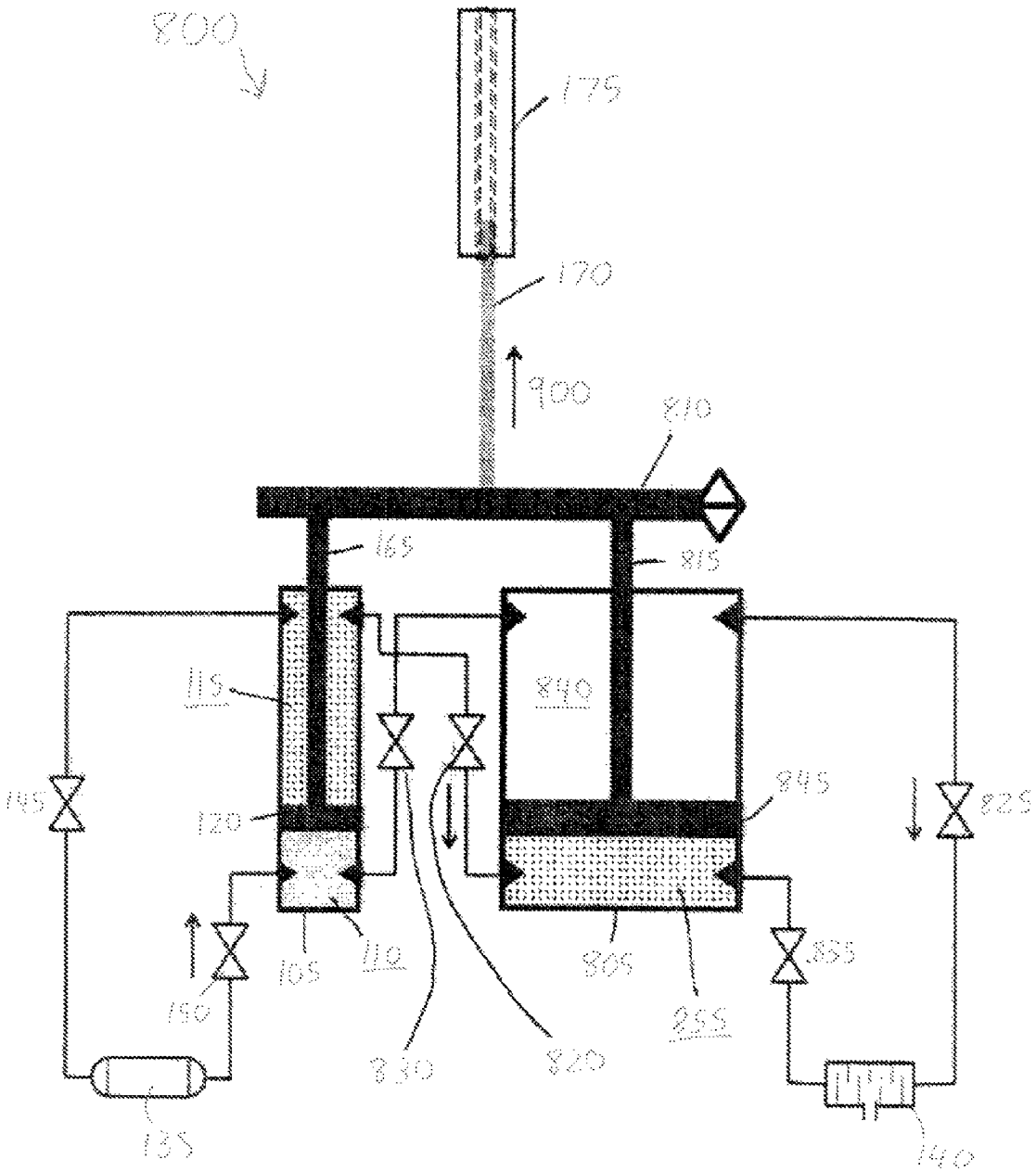
FIG. 9 depicts the mechanism of FIG. 8 in a different phase of operation (i.e., with the high- and low-pressure sides of the pistons reversed and the direction of shaft motion reversed)

System 800 is shown in two operating states, (a) valves 150, 820, and 825 closed and valves 145, 830, and 835 open (shown in FIG. 8), and (b) valves 150, 820, and 825 open and valves 145, 830 and 835 closed (shown in FIG. 9). FIG. 8 depicts state (a), in which gas flows from the high-pressure reservoir 135 through valve 145 into compartment 115 of the high-pressure cylinder 105. Intermediate-pressure gas (depicted by stippled areas) is directed from the other compartment 110 of the high-pressure cylinder 105 by piping through valve 830 to compartment 840 of the low-pressure cylinder 805. The force of this intermediate-pressure gas on the piston 845 acts in the same direction (i.e., in direction indicated by the arrow 850) as the high-pressure gas in compartment 115 of the high-pressure cylinder 105. The cylinders thus act jointly to move the common beam 810 and the translator 170 of the linear motor/generator 175 in the direction indicated by arrow 850, generating electricity during the stroke. Low-pressure gas is vented from the low-pressure cylinder 805 through the vent 140 via valve 835.

FIG. 9 shows the second operating state (b) of system 800, i.e., valves 150, 820, and 825 are open and valves 145, 830 and 835 are closed. In this state, gas flows from the high-pressure reservoir 135 through valve 150 into compartment 110 of the high-pressure cylinder 105. Intermediate-pressure gas is directed from compartment 115 of the high-pressure cylinder 105 by piping through valve 820 to compartment 855 of the low-pressure cylinder 805. The force of this intermediate-pressure gas on the piston 845 acts in the same direction (i.e., in direction indicated by the arrow 900) as that exerted on piston 120 by the high-pressure gas in compartment 110 of the high-pressure cylinder 105. The cylinders thus act jointly to move the common beam 810 and the translator 170 of the linear motor/generator 175 in the direction indicated, generating electricity during the stroke, which is in the direction opposite to that of the operating state shown in FIG. 8. Low-pressure gas is vented from the low-pressure cylinder 805 through the vent 140 via valve 825.

The spray arrangement for heat exchange shown in FIGS. 3 and 4 or, alternatively or in combination, the external heat-exchanger arrangement shown in FIG. 5 may be straightforwardly adapted to the pneumatic cylinders of system 800, enabling substantially isothermal expansion of the gas in the high-pressure reservoir 135. Moreover, this exemplary embodiment may be operated as a compressor (not shown) rather than a generator (shown). Finally, the principle of adding cylinders operating at progressively lower pressures in series (pneumatic) and in parallel (mechanically) may be extended to three or more cylinders.

Figure 10:
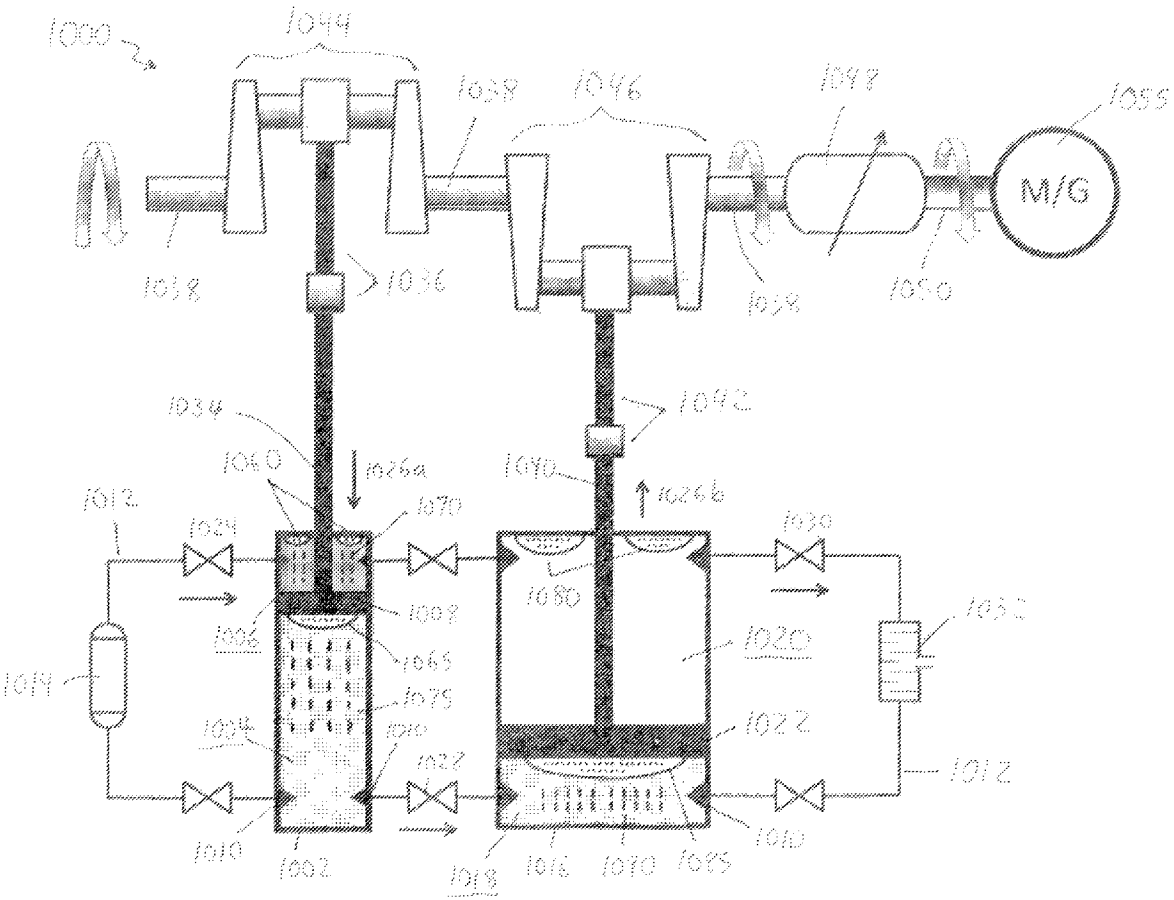
FIG. 10 is a schematic diagram of a system and related method for substantially isothermal compression and expansion of a gas for energy storage using one or more pneumatic cylinders in accordance with various embodiments of the invention.

FIG. 10 is a schematic diagram of a system 1000 for achieving substantially isothermal compression and expansion of a gas for energy storage and recovery using a pair of pneumatic cylinders (shown in partial cross-section) with integrated heat exchange. In this illustrative embodiment, the reciprocal motion of the cylinders is converted to rotary motion via mechanical means. Depicted are a pair of double-acting pneumatic cylinders with appropriate valving and mechanical linkages; however, any number of single- or double-acting pneumatic cylinders, or any number of groups of single- or double-acting pneumatic cylinders, where each group contains two or more cylinders, may be employed in such a system. Likewise, a wrist-pin connecting-rod type crankshaft arrangement is depicted in FIG. 10, but other mechanical means for converting reciprocal motion to rotary motion are contemplated and considered within the scope of the invention.

In various embodiments, the system 1000 includes a first pneumatic cylinder 1002 divided into two compartments 1004, 1006 by a piston 1008. The cylinder 1002, which is shown in a vertical orientation in this illustrative embodiment, has one or more ports 1010 (only one is explicitly labeled) that are connected via piping 1012 to a compressed-gas reservoir 1014.

The system 1000 as shown in FIG. 10 includes a second pneumatic cylinder 1016 operating at a lower pressure than the first cylinder 1002. The second pneumatic cylinder 1016 is divided into two compartments 1018, 1020 by a piston 1022 and includes one or more ports 1010 (only one is explicitly labeled). Both cylinders 1002, 1016 are double-acting in this illustrative embodiment. They are attached in series (pneumatically); thus, after expansion in one compartment of the high-pressure cylinder 1002, the mid-pressure gas (depicted by stippled areas) is directed for further expansion to a compartment of the low-pressure cylinder 1016.

In the state of operation depicted in FIG. 10, pressurized gas (e.g., approximately 3,000 psig) from the reservoir 1014 passes through a valve 1024 and drives the piston 1008 of the double-acting high-pressure cylinder 1002 in the downward direction as shown by the arrow **1026*a*. Gas that has already expanded to a mid-pressure (e.g., approximately 250 psig) in the lower chamber 1004 of the high-pressure cylinder 1002 is directed through a valve 1028 to the lower chamber 1018 of the larger volume low-pressure cylinder 1016, where it is further expanded. This gas exerts an upward force on the piston 1022 with resulting upward motion of the piston 1022 and shaft 1040 as indicated by the arrow 1026*b*. Gas within the upper chamber 1020 of cylinder 1016 has already been expanded to atmospheric pressure and is vented to the atmosphere through valve 1030 and vent 1032**. The function of this two-cylinder arrangement is to reduce the range of pressures and forces over which each cylinder operates, as described earlier.

The piston shaft 1034 of the high-pressure cylinder 1002 is connected by a hinged connecting rod 1036 or other suitable linkage to a crankshaft 1038. The piston shaft 1040 of the low-pressure cylinder 1016 is connected by a hinged connecting rod 1042 or other suitable linkage to the same crankshaft 1038. The motion of the piston shafts 1034, 1040 is shown as rectilinear, whereas the linkages 1036, 1042 have partial rotational freedom orthogonal to the axis of the crankshaft 1038.

In the state of operation shown in FIG. 10, the piston shaft 1034 and linkage 1036 are drawing the crank 1044 in a downward direction (as indicated by arrow 1026*a*) while the piston shaft 1040 and linkage 1042 are pushing the crank 1046 in an upward direction (as indicated by arrow 1026*b*). The two cylinders 1002, 1016 thus act jointly to rotate the crankshaft 1038. In FIG. 10, the crankshaft 1038 is shown driving an optional transmission mechanism 1048 whose output shaft 1050 rotates at a higher rate than the crankshaft 1038. Transmission mechanism 1048 may be, e.g., a gear box or a CVT (as shown in FIG. 10). The output shaft 1050 of transmission mechanism 1048 drives an electric motor/generator 1055 that generates electricity. In some embodiments, crankshaft 1038 is directly connected to and drives motor/generator 1055.

Power electronics may be connected to the motor/generator 1055 (and may be software-controlled), thus providing control over air expansion and/or compression rates. These power electronics are not shown, but are well-known to a person of ordinary skill in the art.

In the embodiment of the invention depicted in FIG. 10, liquid sprays may be introduced into any of the compartments of the cylinders 1002, 1016. In both cylinders 1002, 1016, the liquid spray enables expedited heat transfer to the gas being expanded (or compressed) in the cylinder (as detailed above). Sprays 1070, 1075 of droplets of liquid may be introduced into the compartments of the high-pressure cylinder 1002 through perforated spray heads 1060, 1065. The liquid spray in chamber 1006 of cylinder 1002 is indicated by dashed lines 1070, and the liquid spray in chamber 1004 of cylinder 1002 is indicated by dashed lines 1075. Water (or other appropriate heat-transfer fluid) is conveyed to the spray heads 1060 by appropriate piping (not shown). Fluid may be conveyed to spray head 1065 on the piston 1008 by various methods; in one embodiment, the fluid is conveyed through a center-drilled channel (not shown) in the piston rod 1034, as described in U.S. patent application Ser. No. 12/690,513 (the '513 application), the disclosure of which is hereby incorporated by reference herein in its entirety. Liquid flow to both sets of spray heads is typically controlled by an appropriate valve arrangement (not shown). Liquid may be removed from the cylinders through suitable ports (not shown).

The heat-transfer liquid sprays 1070, 1075 warm the high-pressure gas as it expands, enabling substantially isothermal expansion of the gas. If gas is being compressed, the sprays cool the gas, enabling substantially isothermal compression. A liquid spray may be introduced by similar means into the compartments of the low-pressure cylinder 1016 through perforated spray heads 1080, 1085. Liquid spray in chamber 1018 of cylinder 1016 is indicated by dashed lines 1090.

In the operating state shown in FIG. 10, liquid spray transfers heat to (or from) the gas undergoing expansion (or compression) in chambers 1004, 1006, and 1018, enabling a substantially isothermal process. Spray may be introduced in chamber 1020, but this is not shown as little or no expansion is occurring in that compartment during venting. The arrangement of spray heads shown in FIG. 10 is illustrative only, as any number and disposition of spray heads and/or spray rods inside the cylinders 1002, 1016 are contemplated as embodiments of the present invention.

Figure 11:
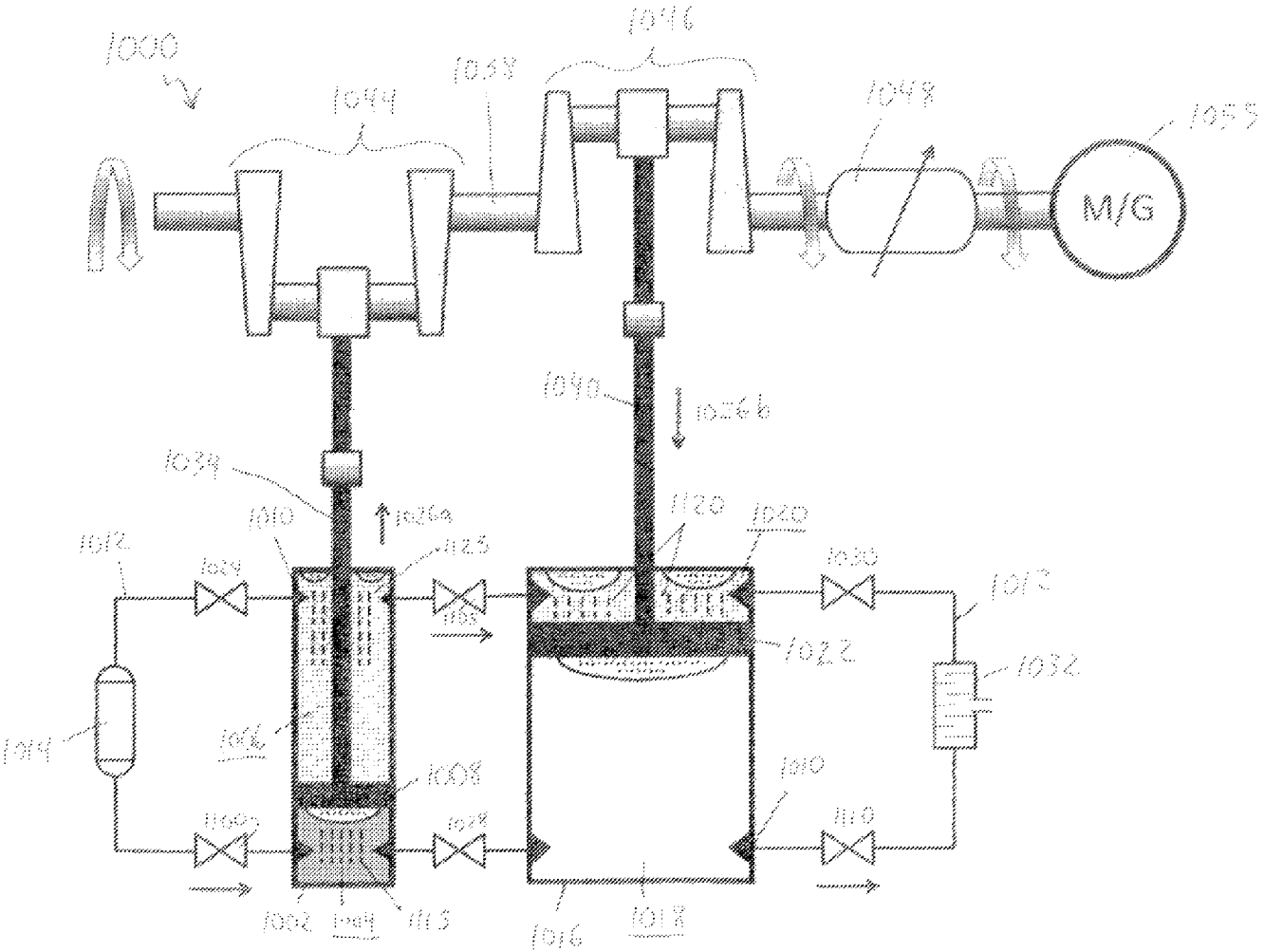
FIG. 11 is a schematic diagram of the system of FIG. 10 in a different phase of operation.

FIG. 11 depicts system 1000 in a second operating state, in which the piston shafts 1034, 1040 of the two pneumatic cylinders 1002, 1016 have directions of motion opposite to those shown in FIG. 10, and the crankshaft 1038 continues to rotate in the same sense as in FIG. 10. In FIG. 11, valves 1024, 1028, and 1030 are closed and valves 1100, 1105, and 1110 are open. Gas flows from the high-pressure reservoir 1014 through valve 1100 into compartment 1004 of the high-pressure cylinder 1002, where it applies an upward force on piston 1008. Mid-pressure gas in chamber 1006 of the high-pressure cylinder 1002 is directed through valve 1105 to the upper chamber 1020 of the low-pressure cylinder 1016, where it is further expanded. The expanding gas exerts a downward force on the piston 1022 with resulting motion of the piston 1022 and shaft 1040 as indicated by the arrow 1026*b*. Gas within the lower chamber 1018 of cylinder 1016 is already expanded to approximately atmospheric pressure and is being vented to the atmosphere through valve 1110 and vent 1032. In FIG. 11, gas expanding in chambers 1004, 1006 and 1020 exchanges heat with liquid sprays 1115, 1125, and 1120 (depicted as dashed lines) to keep the gas at approximately constant temperature.

The spray-head heat-transfer arrangement shown in FIGS. 10 and 11 for vertically oriented cylinders may be replaced or augmented with a spray-rod heat-transfer scheme for arbitrarily oriented cylinders (as mentioned above). Additionally, the systems shown may be implemented with an external gas heat exchanger instead of (or in addition to) liquid sprays, as described in the '235 application. An external gas heat exchanger also enables expedited heat transfer to or from the gas being expanded (or compressed) in the cylinders. With an external heat exchanger, the cylinders may be arbitrarily oriented.

In all operating states, the two cylinders 1002, 1016 in FIGS. 10 and 11 are preferably 180° out of phase. For example, whenever the piston 1008 of the high-pressure cylinder 1002 has reached its uppermost point of motion, the piston 1022 of the low-pressure cylinder 1016 has reached its nethermost point of motion. Similarly, whenever the piston 1022 of the low-pressure cylinder 1016 has reached its uppermost point of motion, the piston 1008 of the high-pressure cylinder 1002 has reached its nethermost point of motion. Further, when the two pistons 1008, 1022 are at the midpoints of their respective strokes, they are moving in opposite directions. This constant phase relationship is maintained by the attachment of the piston rods 1034, 1040 to the two cranks 1044, 1046, which are affixed to the crankshaft 1038 so that they lie in a single plane on opposite sides of the crankshaft 1038 (i.e., they are physically 180° apart). At the moment depicted in FIG. 10, the plane in which the two cranks 1044, 1046 lie is coincident with the plane of the figure.

Figure 12:
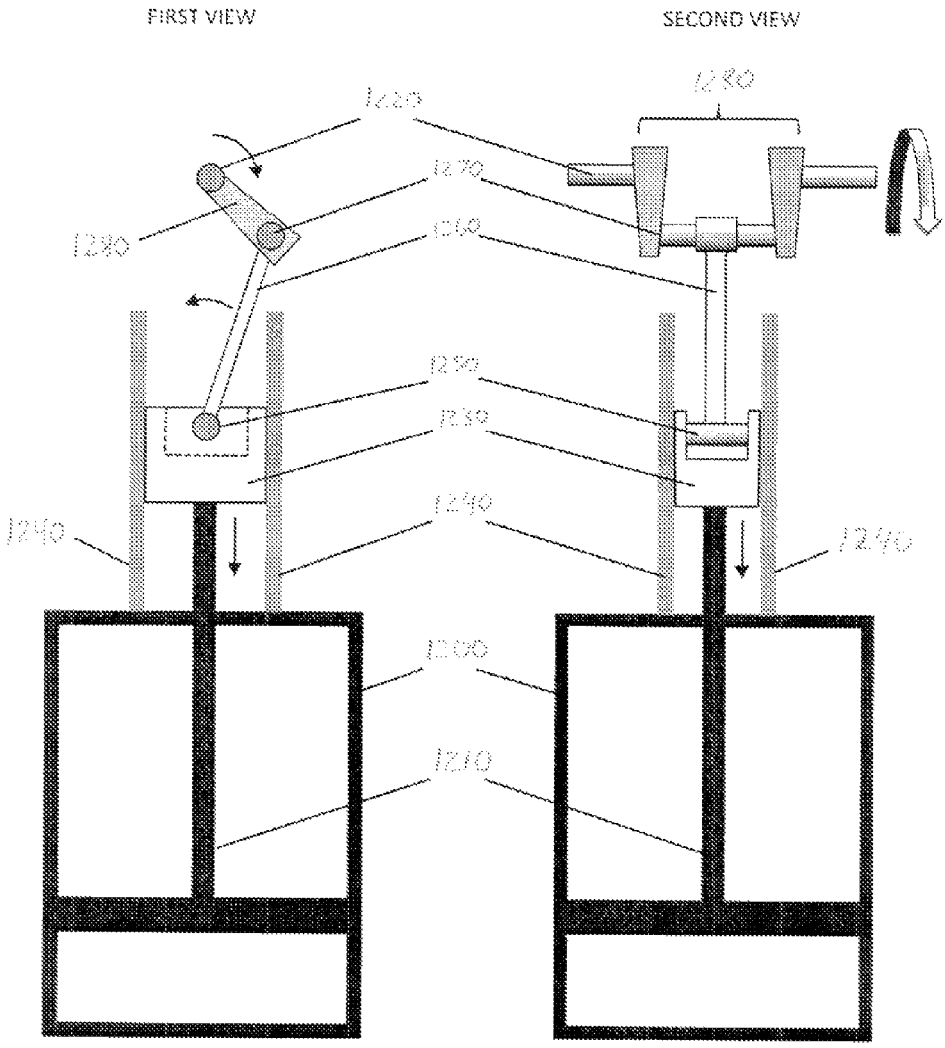
FIG. 12 is a schematic diagram of a system and related method for coupling a cylinder shaft to a crankshaft.

Reference is now made to FIG. 12, which is a schematic depiction of a single pneumatic cylinder assembly 1200 and a mechanical linkage that may be used to connect the rod or shaft 1210 of the cylinder assembly to a crankshaft 1220. Two orthogonal views of the linkage and piston are shown in partial cross section in FIG. 12. In this illustrative embodiment, the linkage includes a crosshead 1230 mounted on the end of the rod 1210. The crosshead 1230 is slidably disposed within a distance piece 1240 that constrains the lateral motion of the crosshead 1230. The distance piece 1240 may also fix the distance between the top of the cylinder 1200 and a housing (not depicted) of the crankshaft 1220.

A connecting pin 1250 is mounted on the crosshead 1230 and is free to rotate around its own long axis. A connecting rod

1260 is attached to the connecting pin 1250. The other end of the connecting rod 1260 is attached to a collar-and-pin linkage 1270 mounted on a crank 1280 affixed to the crankshaft 1220. A collar-and-pin linkage 1270 is illustrated in FIG. 12, but other mechanisms for attaching the connecting rod 1260 to the crank 1280 are contemplated within embodiments of the invention. Moreover, either or both ends of the crankshaft 1220 may be extended to attach to further cranks (not shown) interacting with other cylinders or may be linked to a gear box (or other transmission mechanism such as a CVT), motor/generator, flywheel, brake, or other device(s).

The linkage between cylinder rod 1210 and crankshaft 1220 depicted in FIG. 12 is herein termed a "crosshead linkage, which transforms substantially rectilinear mechanical force acting along the cylinder rod 1210 into torque or rotational force acting on the crankshaft 1220. Forces transmitted by the connecting rod 1260 and not acting along the axis of the cylinder rod 1210 (e.g., lateral forces) act on the connecting pin 1250, crosshead 1230, and distance piece 1240, but not on the cylinder rod 1210. Thus, advantageously, any gaskets or seals (not depicted) through which the cylinder rod 1210 slides while passing into cylinder 1200 are subject to reduced stress, enabling the use of less durable gaskets or seals, increasing the lifespan of the employed gaskets or seals, or both.

Figure 13A:
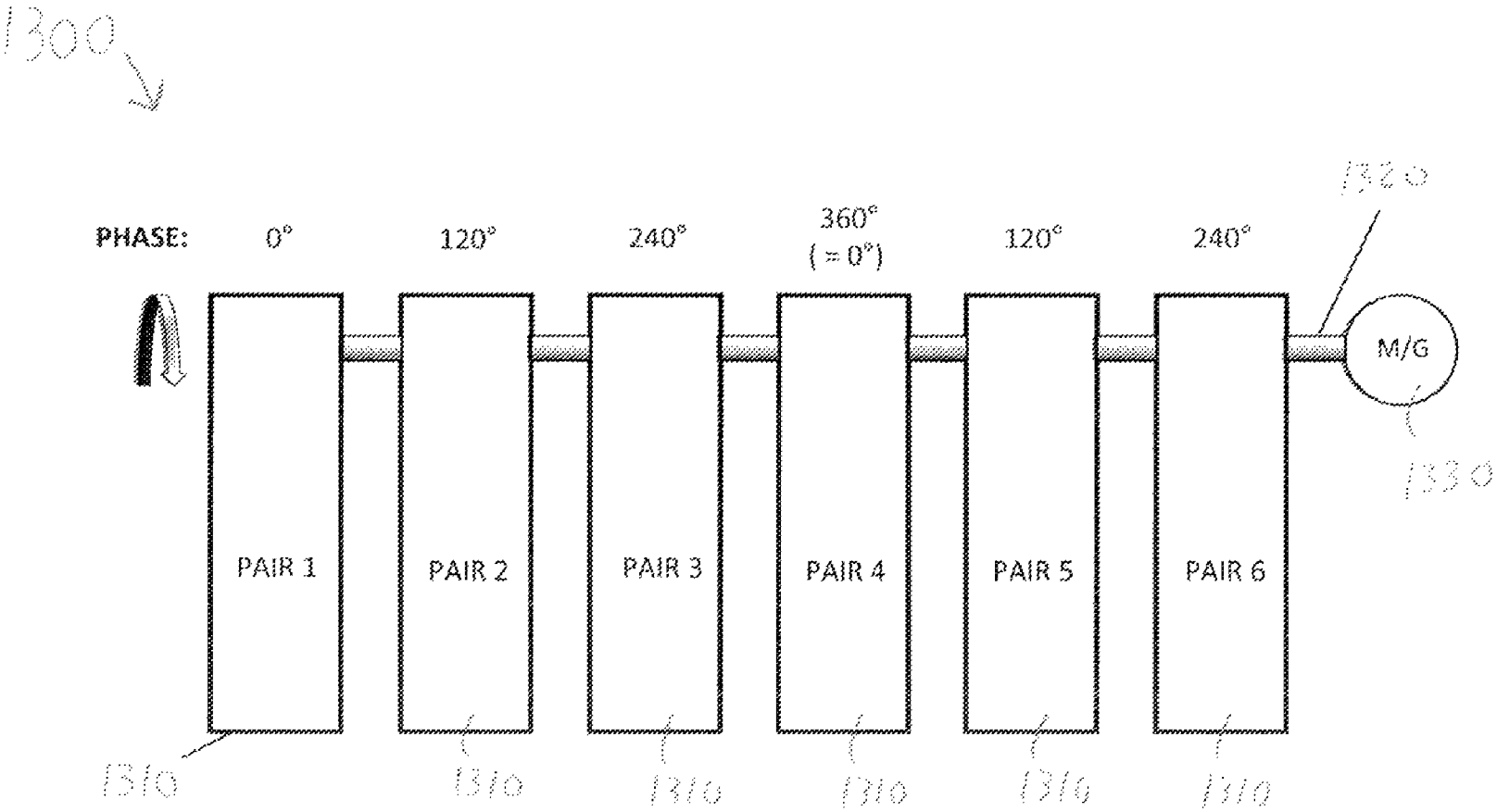
FIGS. 13A and 13B are schematic diagrams of systems in accordance with various embodiments of the invention, in which multiple cylinder groups are coupled to a single crankshaft.
Figure 13B:
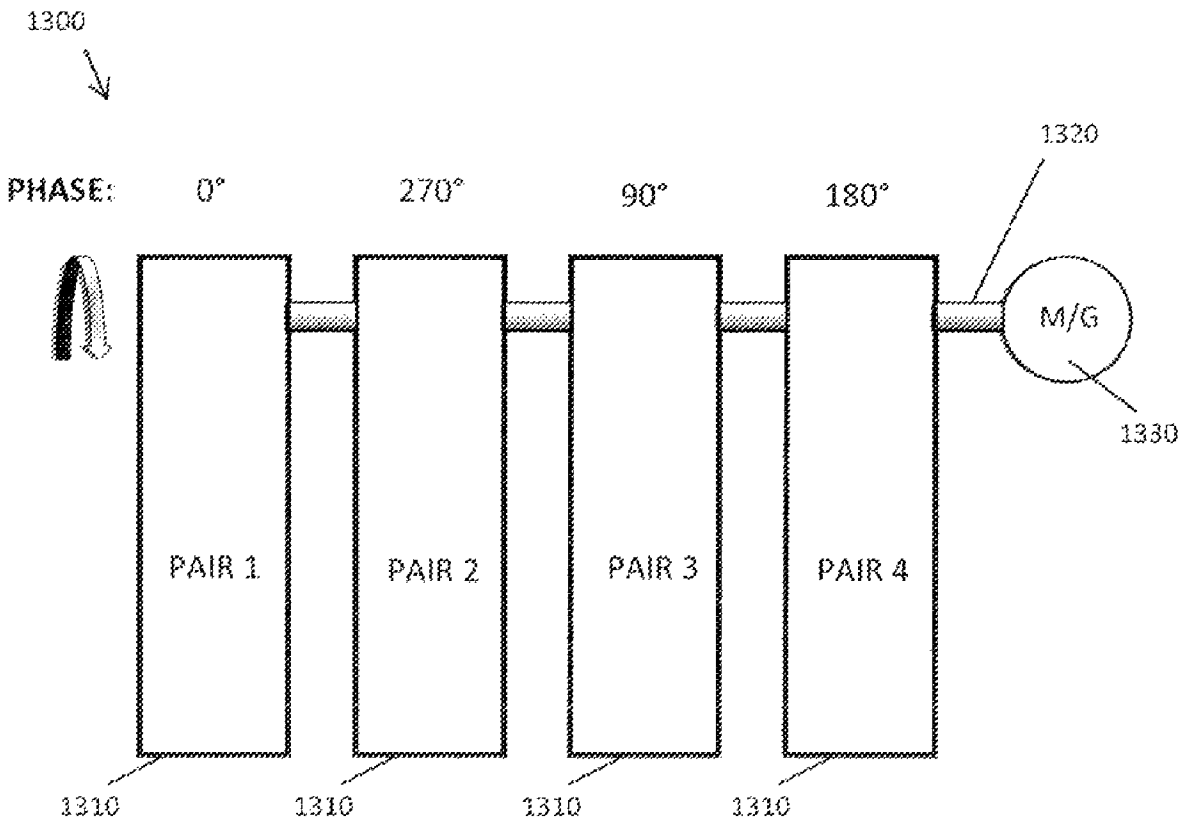

FIGS. 13A and 13B are schematics of a system 1300 for substantially isothermal compression and expansion of a gas for energy storage and recovery using multiple pairs 1310 of pneumatic cylinders with integrated heat exchange. Storage of compressed air, venting of low-pressure air, and other components of the system 1300 are not depicted in FIGS. 13A and 13B, but are consistent with the descriptions of similar systems herein. Each rectangle in FIGS. 13A and 13B labeled PAIR 1, PAIR 2, etc. represents a pair of pneumatic cylinders (with appropriate valving and linkages, not explicitly depicted) similar to the pair of cylinders depicted in FIG. 10. Each cylinder pair 1310 is a pair of fluidly linked pneumatic cylinders communicating with a common crankshaft 1320 by a mechanism that may resemble those shown in FIG. 10 or FIG. 12 (or may have some other form). The crankshaft 1320 may communicate (with or without an intervening transmission mechanism) with an electric motor/generator 1330 that may thus generate electricity.

In various embodiments, within each of the cylinder pairs 1310 shown in FIGS. 13A and 13B, the high-pressure cylinder (not explicitly depicted) and the low-pressure cylinder (not explicitly depicted) are 180° out of phase with each other, as depicted and described for the two cylinders 1002, 1016 in FIG. 10. For simplicity, the phase of each cylinder pair 1310 is identified herein with the phase of its high-pressure cylinder. In the embodiment depicted in FIG. 13A, which includes six cylinder pairs 1310, the phase of PAIR 1 is arbitrarily denoted 0°. The phase of PAIR 2 is 120°, the phase of PAIR 3 is 240°, the phase of PAIR 4 is 360° (equivalent to 0°), the phase of PAIR 5 is 120°, and the phase of PAIR 6 is 240°. There are thus three sets of cylinder pairs that are in phase, namely PAIR 1 and PAIR 4)(0°), PAIR 2 and PAIR 5 (120°), and PAIR 3 and PAIR 6) (240°). These phase relationships are set and maintained by the affixation to the crankshaft 1320 at appropriate angles of the cranks (not explicitly depicted) linked to each of the cylinders in the system 1300.

In the embodiment depicted in FIG. 13B, which includes four cylinder pairs 1310, the phase of PAIR 1 is also denoted 0°. The phase of PAIR 2 is then 270°, the phase of PAIR 3 is 90°, and the phase of PAIR 4 is 180°. As in FIG. 13A, these phase relationships are set and maintained by the affixation to the crankshaft 1320 at appropriate angles of the cranks linked to each of the cylinders in the system 1300.

Linking an even number of cylinder pairs 1310 to a single crankshaft 1320 advantageously balances the forces acting on the crankshaft: unbalanced forces generally tend to either require more durable parts or shorten component lifetimes. An advantage of specifying the phase differences between the cylinder pairs 1310 as shown in FIGS. 13A and 13B is minimization of fluctuations in total force applied to the crankshaft 1320. Each cylinder pair 1310 applies a force varying between zero and some maximum value (e.g., approximately 330,000 lb) during the course of a single stroke. The sum of all the torques applied by the multiple cylinder pairs 1310 to the crankshaft 1320 as arranged in FIGS. 13A and 13B varies by less than the torque applied by a single cylinder pair 1310, both absolutely and as a fraction of maximum torque, and is typically never zero.

Generally, the systems described herein may be operated in both an expansion mode and in the reverse compression mode as part of a full-cycle energy storage system with high efficiency. For example, the systems may be operated as both compressor and expander, storing electricity in the form of the potential energy of compressed gas and producing electricity from the potential energy of compressed gas. Alternatively, the systems may be operated independently as compressors or expanders.

In addition, the systems described above, and/or other embodiments employing liquid-spray heat exchange or external gas heat exchange (as detailed above), may draw or deliver thermal energy via their heat-exchange mechanisms to external systems (not shown) for purposes of cogeneration, as described in the '513 application.

The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method for energy storage and recovery suitable for the efficient use and conservation of energy resources, the method comprising:

at least one of expanding or compressing a gas via reciprocal motion within a pneumatic cylinder assembly, the reciprocal motion arising from or being converted into rotary motion, whereby energy is recovered and stored during expansion and compression of the gas, respectively; and during the at least one of expansion or compression, exchanging heat with the gas by spraying a heat-transfer liquid into the gas via a spray mechanism in order to maintain the gas at a substantially constant temperature, thereby increasing efficiency of the energy recovery and storage, wherein (i) the spray mechanism comprises at least one of a spray head or a spray rod fluidly connected to a circulation mechanism configured to circulate the heat-transfer liquid into the pneumatic cylinder assembly via the spray mechanism at high pressures ranging between 300 psi and 3000 psi, (ii) the heat exchanging is performed by a heat-exchange subsystem, and (iii) a control system controls the pneumatic cylinder assembly and the heat-exchange subsystem to enforce substantially isothermal expansion or compression of the gas.

2. The method of claim 1, wherein the reciprocal motion arises from or is converted into rotary motion of a motor/generator, thereby consuming or generating electricity.

3. The method of claim 1, wherein the reciprocal motion arises from or is converted into rotary motion by a transmission mechanism.

4. The method of claim 3, wherein the transmission mechanism comprises a crankshaft.

5. The method of claim 3, wherein the transmission mechanism comprises a crankshaft and a gear box.

6. The method of claim 3, wherein the transmission mechanism comprises a crankshaft and a continuously variable transmission.

7. The method of claim 1, wherein the gas is expanded via reciprocal motion, and further comprising venting the expanded gas to the atmosphere.

8. The method of claim 1, wherein the gas is compressed via reciprocal motion, and further comprising storing the compressed gas in a compressed-gas reservoir.

9. The method of claim 4, wherein the at least one of expansion or compression comprises at least one of expanding or compressing the gas progressively within the pneumatic cylinder assembly and at least one additional cylinder, the pneumatic cylinder assembly and the at least one additional cylinder forming a plurality of cylinders coupled in series pneumatically.

10. The method of claim 9, wherein the plurality of cylinders are mechanically coupled to the crankshaft in parallel.

11. The method of claim 4, wherein (i) the pneumatic cylinder assembly comprises a first compartment, a second compartment, and a piston separating the compartments, and (ii) the piston is mechanically coupled to the crankshaft via a crosshead linkage.

12. The method of claim 11, wherein the pneumatic cylinder assembly is oriented substantially vertically and substantially perpendicular to the crankshaft.

13. The method of claim 1, wherein exchanging heat with the gas comprises circulating the gas to an external heat exchanger during the at least one of expansion or compression.

14. The method of claim 2, wherein the at least one of expansion or compression is performed over a range of pressures, and further comprising maintaining substantially constant power to or from the motor/generator.

15. The method of claim 1, wherein (i) energy stored during compression of the gas originates from an intermittent renewable energy source of wind or solar energy, and (ii) energy is recovered via expansion of the gas when the intermittent renewable energy source is nonfunctional.

16. The method of claim 11, wherein the crosshead linkage comprises a cylinder rod coupled to the piston, and further comprising preventing lateral forces from acting on the cylinder rod.

17. The method of claim 1, wherein the heat-transfer liquid comprises water.

18. The method of claim 1, wherein the reciprocal motion comprises movement of at least a portion of a cylinder rod into the pneumatic cylinder assembly via at least one of a gasket or a seal.

19. The method of claim 1, wherein, for the at least one of expansion or compression, a ratio of maximum pressure within the pneumatic cylinder assembly to minimum pressure within the pneumatic cylinder assembly is greater than or approximately equal to 10.

20. The method of claim 1, wherein the pneumatic cylinder assembly is single-acting.

* * * * *